US009211019B2

(12) United States Patent
Driscoll, Jr. et al.

(10) Patent No.: US 9,211,019 B2
(45) Date of Patent: Dec. 15, 2015

(54) PUMP AND HOUSING CONFIGURATION FOR INFLATING AND DEFLATING AN AIR MATTRESS

(75) Inventors: David Delory Driscoll, Jr., Milwaukee, WI (US); John Joseph Riley, Brookfield, WI (US); Susan Marie Hrobar, Brookfield, WI (US)

(73) Assignee: RAPID AIR LLC., Pewaukee, WI (US)

( * ) Notice: Subject to any disclaimer, the term of this patent is extended or adjusted under 35 U.S.C. 154(b) by 452 days.

(21) Appl. No.: 13/490,205

(22) Filed: Jun. 6, 2012

(65) Prior Publication Data

US 2012/0304391 A1 Dec. 6, 2012

Related U.S. Application Data

(63) Continuation-in-part of application No. 13/426,359, filed on Mar. 21, 2012.

(60) Provisional application No. 61/493,836, filed on Jun. 6, 2011.

(51) Int. Cl.
*A47C 27/10* (2006.01)
*A47C 27/08* (2006.01)
(Continued)

(52) U.S. Cl.
CPC ..... *A47C 27/10* (2013.01); *A47C 27/082* (2013.01); *A47C 27/083* (2013.01); *F04D 17/161* (2013.01); *F04D 25/084* (2013.01)

(58) Field of Classification Search
CPC .. A47C 27/081; A47C 27/082; A47C 27/083; A47C 27/10; A61G 7/05769; A61G 7/05776; F04D 17/161; F04D 25/084
USPC ..... 5/706, 710, 713, 655.3; 417/315
See application file for complete search history.

(56) References Cited

U.S. PATENT DOCUMENTS 3,477,071 A * 11/1969 Emerson ..... 5/609
3,628,894 A 12/1971 Ferguson, Jr.
(Continued)

OTHER PUBLICATIONS

International Search Report for co-pending International Application No. PCT/US2012/41114 dated Aug. 24, 2012.
(Continued)

*Primary Examiner* — Nicholas Polito
(74) *Attorney, Agent, or Firm* — Leydig, Voit & Mayer, Ltd.

(57) ABSTRACT

Efficient systems and methods for inflating, deflating, or simultaneously inflating and deflating air mattress chambers using various pump and pump housing configurations are provided. Examples of the various pump and pump housing configurations include: boundary-layer pumps having single disk array or multiple disk array layouts, different disk geometries, different pressure recovery chamber geometries, adjustable components for switching between filling and powered dumping operations, and reversible and non-reversible motors; and pump housings having one or more dump channels for manifold-driven powered dumping, multiple sides or stages for pressure and/or flow compounding, various manifold chamber configurations for robust connectivity with air mattresses having multiple chambers, and various valve configurations for flexible control over filling, powered dumping, and simultaneous filling and powered dumping operations. Pump products having pumps and pump housings designed according to the principles described herein are able to satisfy a wide range of different performance and cost requirements.

10 Claims, 33 Drawing Sheets

(51) Int. Cl.
*F04D 17/16* (2006.01)
*F04D 25/08* (2006.01)

(56) References Cited

U.S. PATENT DOCUMENTS

| | | | | |
|---|---|---|---|---|
| 4,025,225 | A | 5/1977 | Durant | |
| 4,402,647 | A * | 9/1983 | Effenberger | 415/90 |
| 4,829,618 | A | 5/1989 | Walker | |
| 5,343,893 | A | 9/1994 | Hogan et al. | |
| 5,487,196 | A | 1/1996 | Wilkinson et al. | |
| 5,588,811 | A | 12/1996 | Price | |
| 5,938,410 | A * | 8/1999 | Lee | 417/234 |
| 6,698,046 | B1 | 3/2004 | Wu | |
| 7,246,394 | B2 | 7/2007 | Wang | |
| 7,588,425 | B2 * | 9/2009 | Chung | 417/315 |
| 7,784,131 | B2 | 8/2010 | Genaro et al. | |
| 2002/0119040 | A1 | 8/2002 | Bosley | |
| 2008/0127423 | A1 | 6/2008 | Gammons | |
| 2009/0093912 | A1 * | 4/2009 | Wilker, Jr. | 700/282 |
| 2011/0073202 | A1 | 3/2011 | Feingold et al. | |

OTHER PUBLICATIONS

International Search Report for related co-pending International Application No. PCT/US2012/29977 dated Jul. 24, 2012.

International Preliminary Report on Patentability dated Dec. 27, 2013 for co-pending International Patent Application No. PCT/2012/041114 (8 pages).

* cited by examiner

200

1100A

1100B

1300

1500

1500

1800

2000

2100

2200

2300

2400

2400

2400

2700

2700

2900

3000

PUMP AND HOUSING CONFIGURATION FOR INFLATING AND DEFLATING AN AIR MATTRESS

CROSS-REFERENCE TO RELATED APPLICATIONS

This patent application is a continuation-in-part of copending U.S. patent application Ser. No. 13/426,359, filed on Mar. 21, 2012, which claims the benefit of U.S. Provisional Patent Application No. 61/454,888, filed on Mar. 21, 2011. This patent application claims the benefit of U.S. Provisional Patent Application No. 61/493,836, filed on Jun. 6, 2011, which is incorporated by reference.

BACKGROUND

Commercial airbeds have been growing steadily in popularity. Many types of airbeds have been developed for a variety of applications over the years, ranging from simple and inexpensive airbeds that are convenient for temporary use (such as for house guests and on camping trips), home-use airbeds that replace conventional mattresses in the home, to highly sophisticated medical airbeds with special applications (such as preventing bedsores for immobile patients). With respect to home-use and medical airbeds, more and more consumers are turning to these types of airbeds for the flexibility in firmness that they offer, allowing consumers to adjust their mattresses to best suit their preferences.

Conventional home-use and medical airbeds generally include at least a few main components: a mattress with at least one chamber that can be filled with air, a unit for pumping air into the chamber, and appropriate connections between the mattress and the pumping apparatus. The pumping unit may further include a pump connected to a manifold, with a control mechanism and valves for controlling the pumping of air into the mattress and releasing the air out of the mattress. Conventional pumps used in airbeds are "squirrel-cage" blowers and diaphragm pumps.

The squirrel-cage blowers used in airbeds are relatively inexpensive and simple pumps that rely on a fan to push air into the mattress. While the squirrel-cage blower is able to achieve a relatively high flow rate (e.g. around 75 L/min) and inflate a mattress relatively quickly, it is unable to produce pressures that are high enough to meet the desirable range of pressure for all home-use and medical airbeds (up to about 1 psi), as squirrel-cage blowers are generally limited to about 0.1-0.5 psi. Squirrel-cage blowers tend to be inefficient and therefore will generate higher levels of heat when they are running compared to diaphragm pumps.

The diaphragm pumps used in airbeds, which rely on quasi-positive displacement technology, are generally able to achieve pressures of up to about 5 psi, well beyond the requirements of the airbed industry. However, diaphragm pumps are not capable of as much air flow as squirrel-cage blowers (limited to about 25-50 L/min), and thus take a longer amount of time to fill an air mattress. Diaphragm pumps also generate a moderate amount of noise, but less than squirrel-cage blowers. Diaphragm pumps, for the same relative performance as a squirrel-cage blower, will be two to three times more expensive.

More sophisticated airbeds used in medical applications (e.g. home-care airbeds) have been able to deal with these problems to some degree by integrating both a diaphragm pump and a squirrel cage blower in their airbeds, as well as adding a noise-cancelling housing to encase the pumps. These medical airbeds can start off by filling the airbed quickly at a low pressure with a squirrel cage blower, and switch over to a diaphragm pump to finish the filling and achieve the desired pressure. Additionally, medical airbeds may take into account whether the patient on the bed is asleep or awake in determining which pump to use (e.g. using the noisier squirrel cage pump for rolling over a patient that is awake, or using the relatively quieter diaphragm pump for supplying a constant flow for a wound-care type mattress running while the patient is asleep). However, these solutions result in a steep increase in cost, as well as increasing the size and complexity of the entire pumping unit.

It will be appreciated that the foregoing is a discussion of problems discovered and/or appreciated by the inventors, and is not an attempt to review or catalog the prior art.

SUMMARY

The present invention provides efficient and cost-effective systems and methods for inflating, deflating, or simultaneously inflating and deflating air mattress chambers using various pump and pump housing configurations. Examples of the various pump and pump housing configurations include: boundary-layer pumps having single disk array or multiple disk array layouts, different disk geometries, different pressure recovery chamber geometries, adjustable components for switching between filling and powered dumping operations, and reversible and non-reversible motors; and pump housings having one or more dump channels for manifold-driven powered dumping, multiple sides or stages for pressure and/or flow compounding, various manifold chamber configurations for robust connectivity with air mattresses having multiple chambers, and various valve configurations for flexible control over filling, powered dumping, and simultaneous filling and powered dumping operations. Pump products having pumps and pump housings designed according to the principles described herein are able to satisfy a wide range of different performance and cost requirements.

In an embodiment, a system for utilizing a pump to inflate and deflate an air mattress is provided. The system includes: an air mattress having at least one chamber; a pump adapted to receive a gas through a pump inlet and impel the gas through a pump outlet; and a manifold chamber including at least one outlet connecting the manifold chamber to the at least one chamber of the air mattress, at least one inlet connecting the manifold chamber to the pump outlet; a dump channel providing a connection between the manifold chamber and the pump inlet, wherein during a powered dumping operation, the dump channel is configured to receive gas from the at least one chamber of the air mattress and send the gas to the pump inlet; a plurality of valves adapted for controlling the flow of gas between the pump, the manifold chamber, and the at least one chamber of the air mattress; and a control unit for controlling the pump and valves.

In another embodiment, a method for utilizing a pump to remove gas from at least one chamber of an air mattress is provided. The method includes: connecting, by opening a valve, the at least one chamber to a pump inlet of the pump via a dump channel, wherein the at least one chamber is isolated from a pump outlet of the pump; opening an exhaust valve to connect the pump outlet to an exhaust; and operating the pump so as to draw gas from the at least one chamber to the pump inlet and impel the gas from the pump inlet and out of the pump outlet to the exhaust.

In yet another embodiment, a method for utilizing a boundary-layer pump having at least two sets of disks corresponding to at least two pressure recovery chambers to and dump gas from at least one chamber of an air mattress is provided.

The method includes: receiving an input from a user of the boundary-layer pump; adjusting valves based on whether the input corresponds to at least one of a filling operation, a powered limping operation, and a simultaneous filling and powered dumping operation; and rotating the at least two sets of disks simultaneously to impel gas from inlets corresponding to the at least two pressure recovery chambers to outlets corresponding to the at least two pressure recovery chambers.

In yet another embodiment, a system for utilizing a pump to inflate and deflate an air mattress is provided. The system includes: an air mattress with at least one chamber; a pump adapted to receive a gas through a pump inlet and impel the gas through a pump outlet during a filling operation and adapted to receive a gas through the pump outlet and impel the gas out of an exhaust during a powered dump operation; and a manifold chamber including at least one outlet connecting the manifold to the at least one chamber of the air mattress, at least one inlet connecting the manifold to the pump outlet; a plurality of valves adapted for controlling the flow of gas between the pump, the manifold chamber, and the at least one chamber of the air mattress; and a control unit for controlling the pump, including the adjustable component of the pump, and the valves. The pump includes an adjustable component having at least two settings corresponding to the filling operation and the powered dumping operation, and the adjustable component isolates a pressure recovery chamber of the pump from the exhaust during the filling operation.

Other aspects and advantages of the invention will become apparent upon reading the following detailed description and upon reference to the drawings.

BRIEF DESCRIPTION OF THE SEVERAL VIEWS OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION

Figure 1:
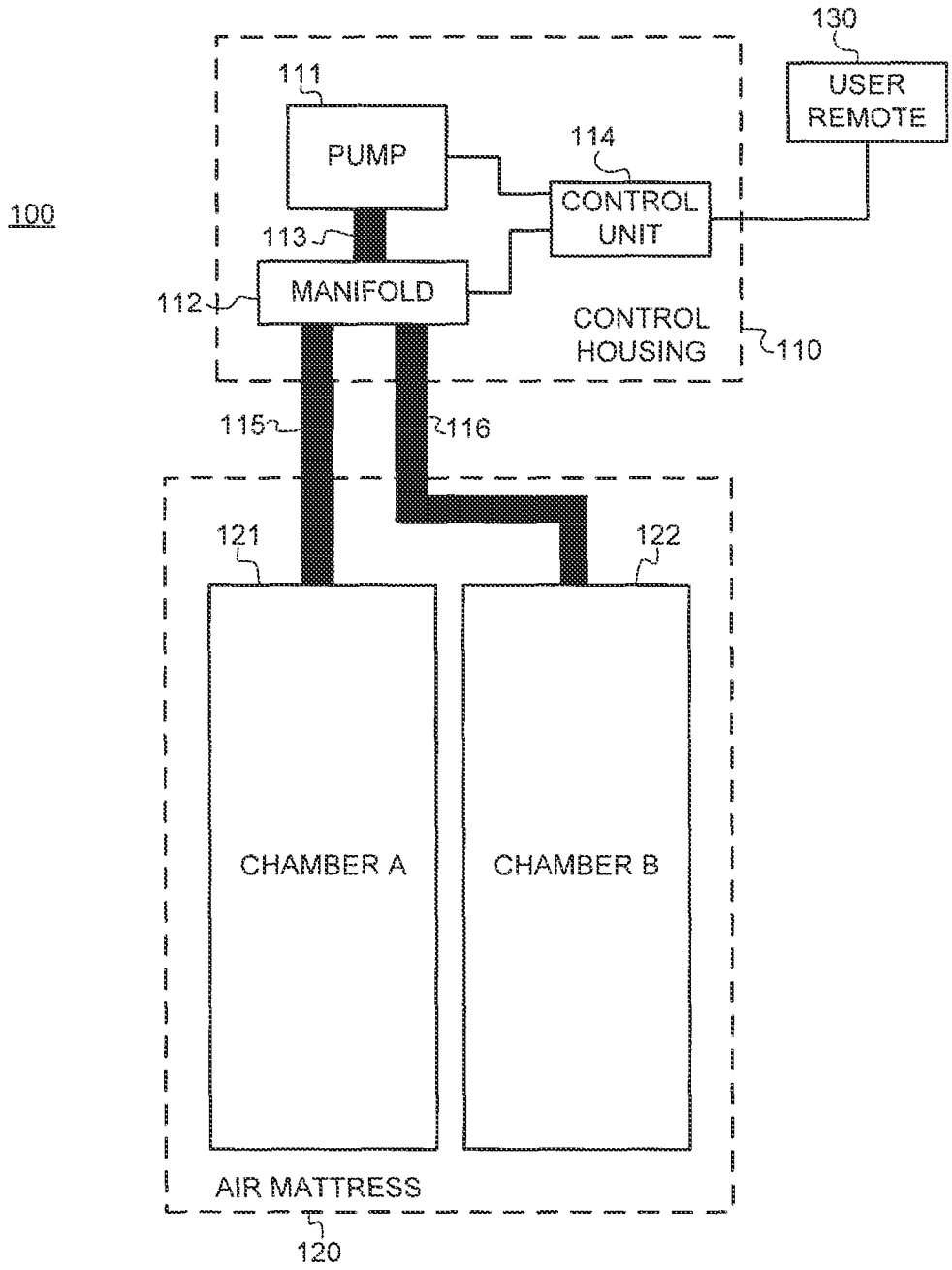
FIG. 1 is a block diagram of an airbed environment useable in embodiments of the described principles.

An exemplary airbed environment 100 in which the invention may operate is depicted by FIG. 1. It will be appreciated that the described environment is an example, and does not imply any limitation regarding the use of other environments to practice the invention. The airbed environment 100 includes a control housing 110 and an air mattress 120. The control housing further includes a control unit 114 and a pump 111, wherein the pump 111 is connected to chambers A 121 and B 122 via an appropriate connection. For example, in FIG. 1, the pump 111 may be connected to the chambers through tubes 113, 115 and 116 and a manifold 112, along with appropriate valves (not depicted). The tubes may be PVC (Polyvinyl Chloride) or silicone rubber or any other appropriate connections for transferring a gas, such as air, from a pump outlet to air mattress chambers. The manifold 112 may be manufactured out of thermoplastic or any other suitable type of material with sufficient mechanical strength to contain the amount of pressure required. For example, for applications requiring about 1 psi of air, materials such as ABS (Acrylonitrile Butadiene Styrene), PP (Polypropylene), PC (Polycarbonate), or PPE (Polyphenylene Ether), may be used. One skilled in the art will appreciate that the type of material used may vary depending on the pressure requirements of the particular application (e.g. a properly designed PPE manifold may withstand up to several hundred psi).

Valves are provided at appropriate locations, for example, at the connection between the manifold 112 and the tubes 113, 115, and 116, and the valves may be in communication with the control unit 114. Solenoid plunger style valves may be preferable due to their electromechanical control capabilities and relatively low cost, but it will be appreciated that other types of valves may be used. A pressure sensor or multiple pressure sensors (not depicted) may be connected to the manifold or valves to monitor the pressure status of the chambers, and the pressure sensor or sensors communicate with the control unit 114, providing the control unit 114 with pressure information corresponding to the manifold or the air mattress chambers.

The control unit 114 preferably includes a printed circuit board assembly (PCBA) with a tangible computer-readable medium with electronically-executable instructions thereon (e.g. RAM, ROM, PROM, volatile, nonvolatile, or other electronic memory mechanism), and a corresponding processor for executing those instructions. The control unit 114 controls the pump 111 and the flow of gas in the airbed environment through the tubes 113, 115, and 116 by opening and closing the appropriate valves. The control unit 114 may further send and receive data to and from a user remote 130, allowing a user of the airbed environment 100 to control the pumping of the air mattress 120 through the control unit 114, as well as displaying information related to the airbed environment 100 to the user. For example, an exemplary remote 130 includes a display that indicates the current pressure status of the chambers of the air mattress 120 or the current pressure target for the chambers, and also includes input buttons that allow the user to communicate the user's desired pressure settings to the control unit 114. The user remote 130 may be connected to the control unit 114 through a wired connection as depicted, or may communicate with the control unit 114 wirelessly through appropriate communications hardware.

It will be appreciated that the airbed environment 100 is merely exemplary and that the principles described herein are not limited to the environment 100 depicted. For example, it will be appreciated that in an alternative embodiment, a mattress 120 with only one chamber may be used. In other embodiments, a mattress 120 with more than two chambers may be provided, with the appropriate number of connections to those mattresses. In yet another alternative embodiment, the manifold 112 may be connected directly to the pump outlet without the use of a tube 113, and in yet another alternative embodiment, the manifold 112 may be located inside the mattress 120 instead of within the control housing 110.

Figure 2:
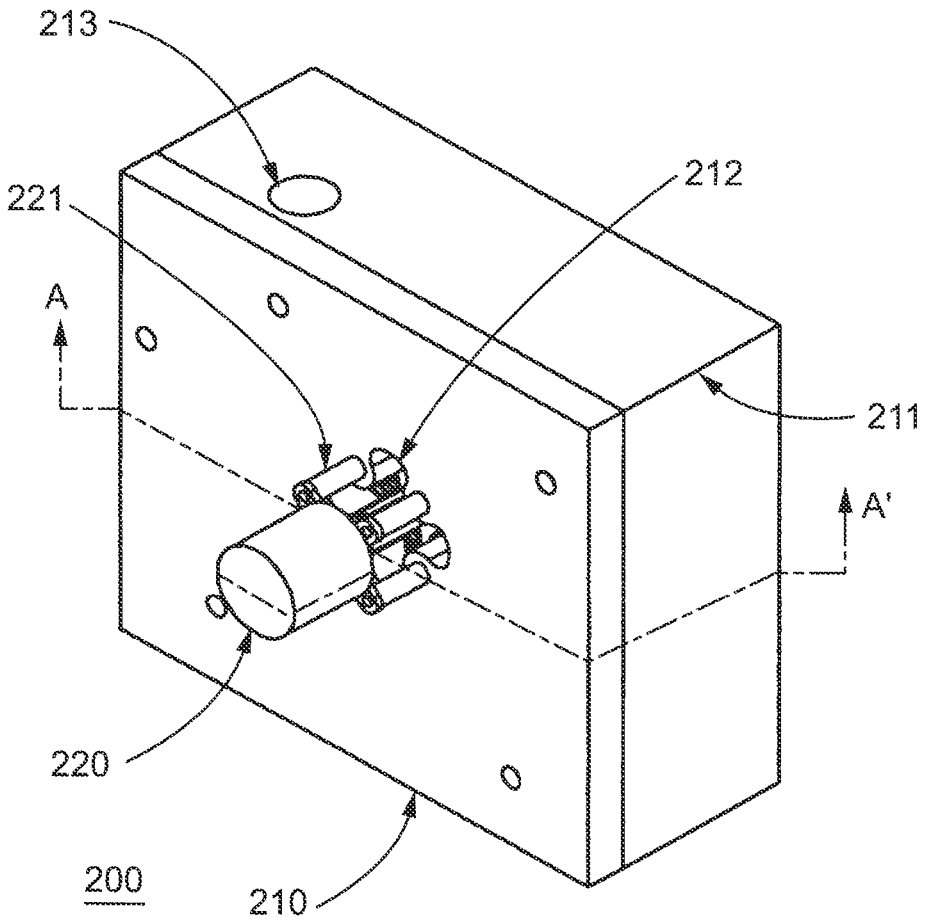
FIG. 2 is a three-dimensional (3D) schematic of an outside view of a pump.

With further reference to the environment of FIG. 1, and turning more specifically to FIG. 2, an outside view of an exemplary boundary-layer pump 200 used in an illustrative embodiment of the described principles is shown. The pump 200 includes a pressure recovery chamber housing, which further includes a pressure recovery chamber housing cover 210 and a pressure recovery chamber housing body 211. A pump inlet 212 is provided on the pressure recovery chamber housing cover 210, and a pump outlet 213 is provided on the pressure recovery chamber housing body 211. The pressure recovery chamber housing body 211 and cover 210 may be made from materials including, but not limited to, plywood, MDF (medium density fibreboard), phenolic, HDPE (high density polyethylene), mahogany, PC, and acrylic.

A motor 220 is attached to the pressure recovery chamber housing cover 210 by motor standoff rods 221, though it will be appreciated that motor standoff rods 221 are not a requirement. The motor 220 may preferably be a brushed or brushless DC (direct current) motor, or any other type of motor that generates a sufficient amount of RPMs. In one embodiment, for example, a Himax HC2812-1080 KV motor may be used with a Castle Creations, Inc. Phoenix ICE 50 or Thunderbird 18 motor controller.

Figure 3:
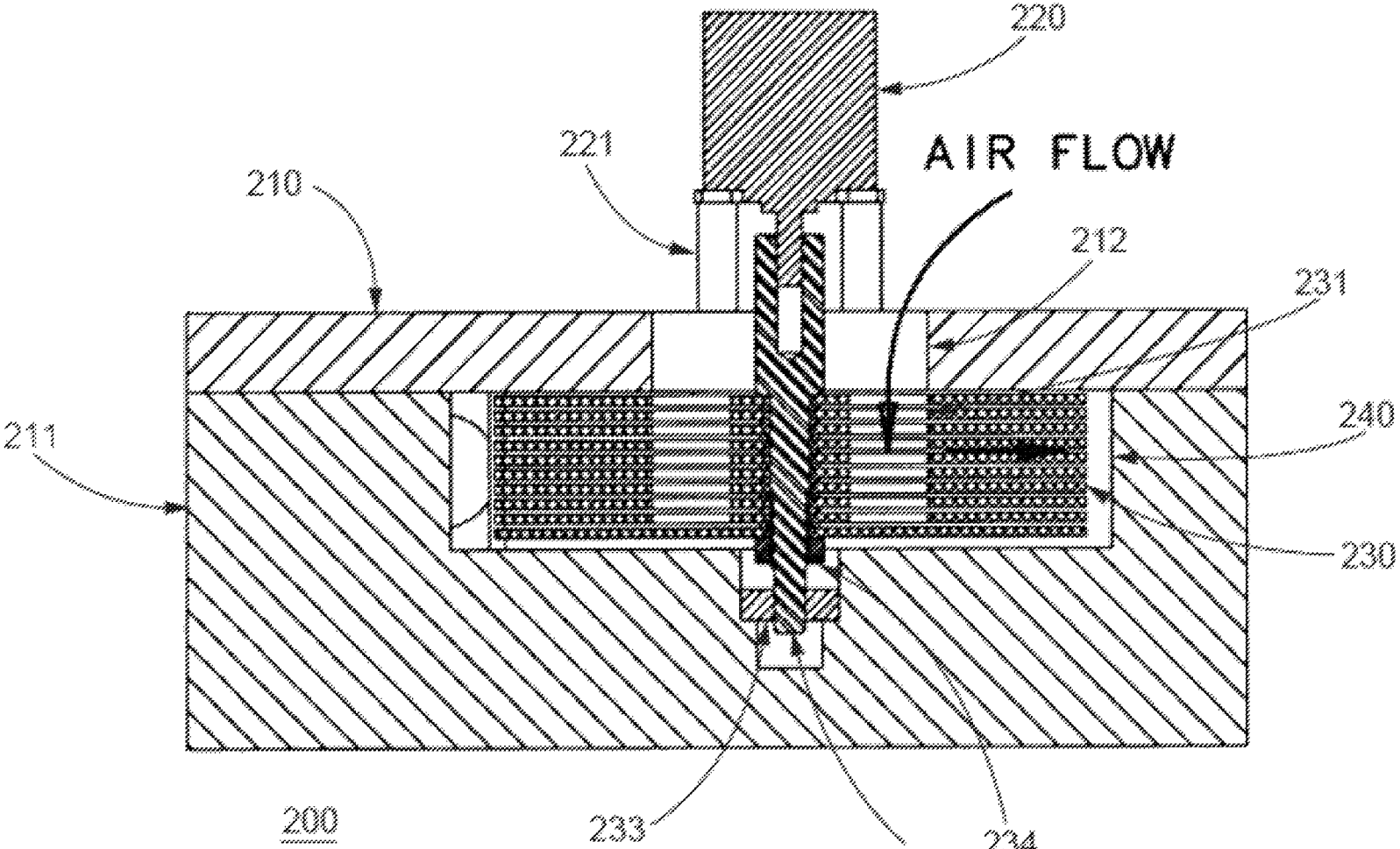
FIG. 3 is a schematic of a cross-sectional view of the pump depicted in FIG. 2.

FIG. 3 provides one cross-sectional view of the exemplary boundary-layer pump 200 along cross-sectional line A-A' of FIG. 2. The shaft of the motor 220 is connected to another shaft 232, which is an arbor adapted to hold the disks 230. The arbor traverses holes at the centers of the disks 230, and is designed to hold the disks 230 in predetermined locations along the arbor. The predetermined locations are depicted as substantially evenly spaced along the arbor, but it will be appreciated that this is not a requirement. Varying the spacing of the disks, unless taken to an extreme, does not significantly affect the performance of the boundary-layer pump 200 in comparison to the other parameters discussed below. The disks 230 have holes at the center of the disks that the shaft 232 traverses. The holes may differ in size and shape according to the shape of the shaft 232. In specific embodiments, the disks may be made from materials including, but not limited to, 0.032" 2024T3 Aluminum, 0.063" Polycarbonate, or conventional compact discs (CDs), and the arbor may be machined from materials including, but not limited to, 304 Stainless Steel or 4130 Steel. In an alternative embodiment, the shaft 232 and the disks 230 may be designed as one continuous piece through an injection-molding process, and would not require holes to be present at the center of the disks.

The disks 230 and at least part of the shaft 232 are within pressure recovery chamber 240, and the shaft 232 is connected to a bottom bearing 233 and a nut 234 at the opposite end from the motor 220. The disk furthest away from the pump inlet 212 is designed with no disk inlets (this disk is called the "base disk"). Allowing gas to travel through the base disk would result in inefficiencies due to the viscous adhesion forces that would be introduced along the adjacent wall of the pressure recovery chamber, causing an increased amount of gas recirculation. A gas, which may be a homogenous or non-homogenous non-compressible fluid (e.g. ambient air), enters through the pump inlet 212 and passes through the disk inlets 231, and is drawn radially outwards from the disk inlets 231 towards the edges of the disks 231 due to the rotation of the disks 231 while the motor 220 rotates the shaft 232. The path traveled by the gas (through the pump inlets and disk inlets, and radially outward along the disks into the pressure recovery chamber and towards the pump outlet) is indicated in FIG. 3 by the bold arrows labeled AIR FLOW.

Figure 4:
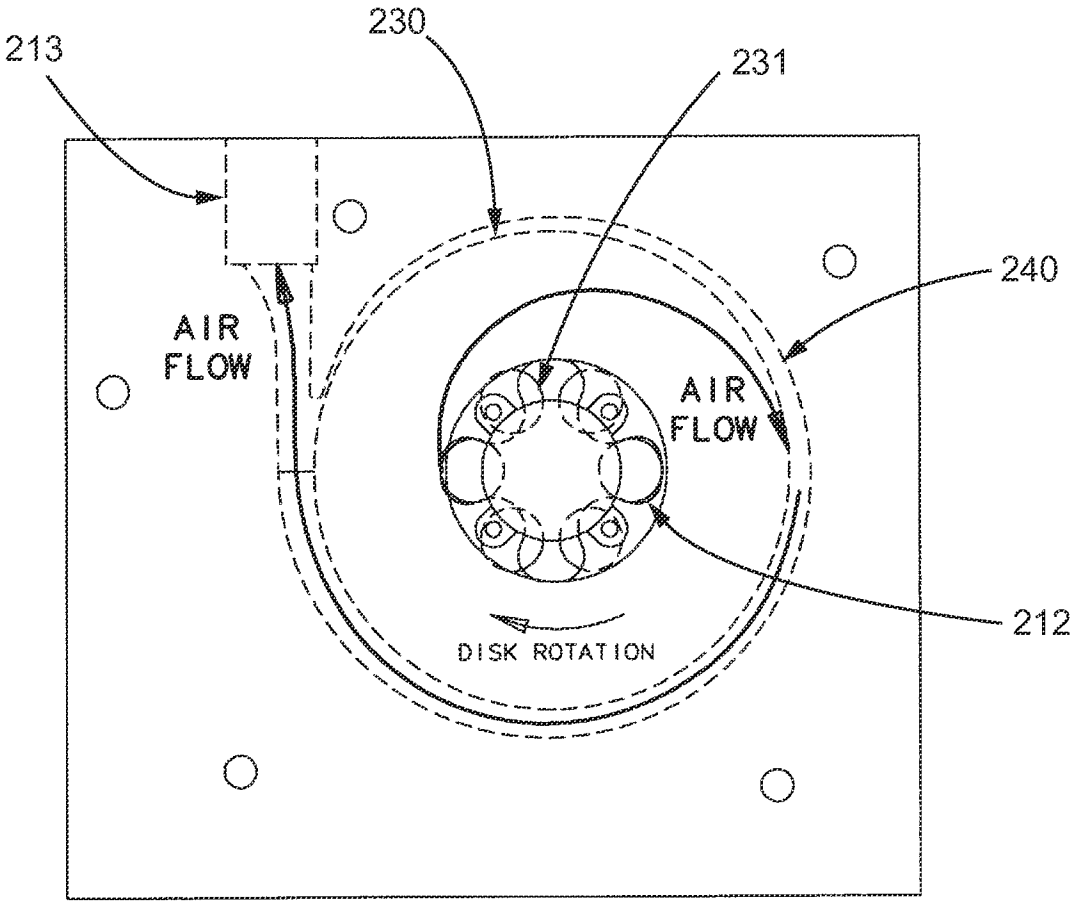
FIG. 4 is a schematic of a semi-transparent top-down view of the pump depicted in FIG. 2 from the pump inlet and motor side.

FIG. 4 provides a semi-transparent top-down view of the boundary-layer pump 200 from the side of the boundary-layer pump 200 having the motor 220 and pump inlet 212. As described above, gas enters the pump 200 through the pump inlet 212 and passes through disk inlets 231. The rotation of the disks in the direction depicted by the arrow marked DISK ROTATION causes the gas to flow radially outward along the disks 230. Gas is flung off of the disks 230 according to the velocity vector associated with the gas at the edges of the disks and is compressed in the pressure recovery involute (the area between the edge of the disks and the edge of the pressure recovery chamber 240) as it ultimately travels towards the pump outlet 213. An example of how gas may flow through the pump 200 is indicated by the bold arrows labeled AIR FLOW.

Figure 5:
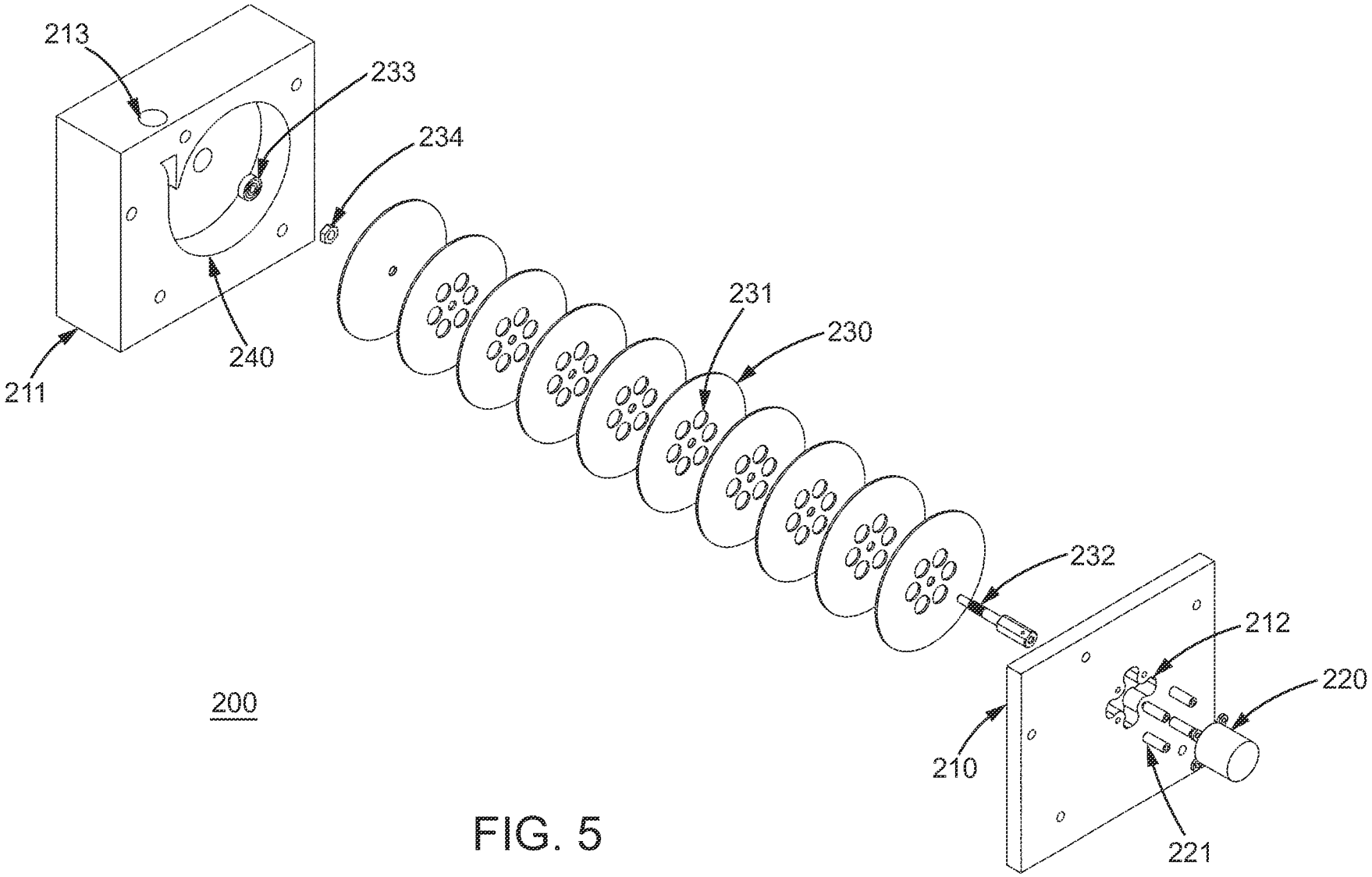
FIG. 5 is a 3D schematic of an exploded view of the components of the pump depicted in FIG. 2.

FIG. 5 provides a 3D schematic of an exploded view of the components of the boundary-layer pump 200. The motor 220, standoff rods 221, pump inlet 212, pressure recovery chamber housing cover 210, shaft 232, disks 230, disk inlet holes 231, nut 234, bearing 233, pressure recovery chamber 240, pressure recovery chamber housing body 211, pump outlet 213, and the order in which these components are arranged in one embodiment are depicted. Although FIGS. 2-5 depict the motor 220 positioned near the pump inlet 212, it will be appreciated that the motor 220 may be positioned on the other side of the pressure recovery chamber housing as well.

Figure 6:
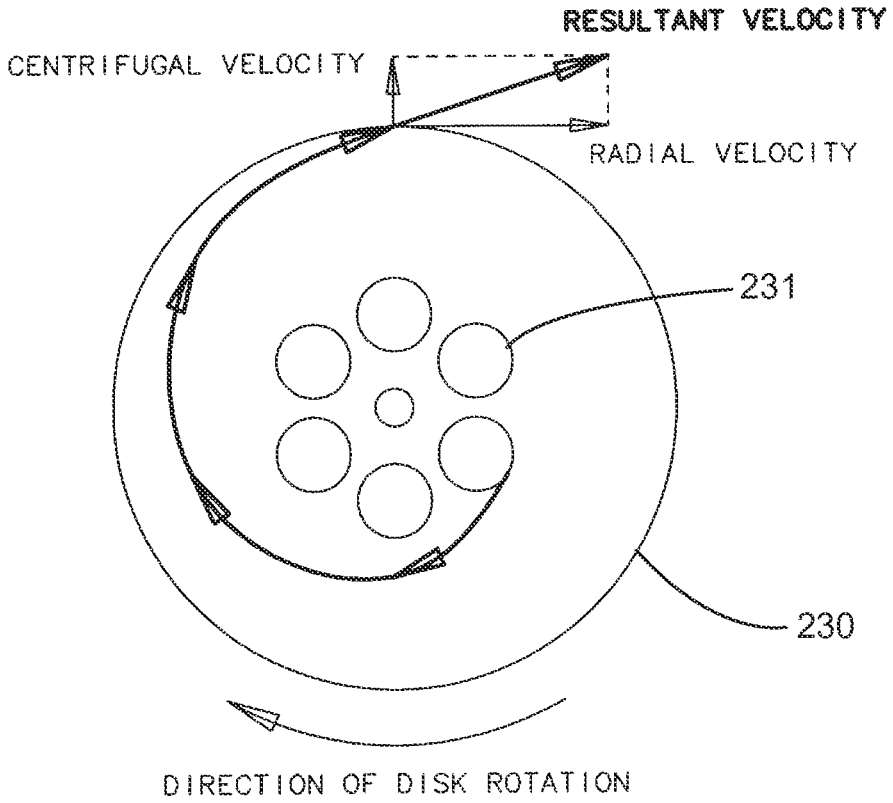
FIG. 6 is a simple vector diagram illustrating the velocity imparted to gas passing through a disk inlet hole by the rotation of the disk.

The pump 200 is referred to as a boundary-layer pump because it employs the boundary-layer effect on air surrounding spinning disks in the pump to transfer energy from the spinning disks to the air. Air, which is drawn into the pump inlet 212 due to a region of low pressure produced by the rotation of the disks 230, enters through the inlet holes 231 on the disks 230 and is subject to viscous boundary layer adhesion forces that impart a velocity profile including a centrifugal component and a radial component, as depicted by FIG. 6. The air within the boundary layer created by the rotation of the disks works it way outwards in a spiral path with the velocity profile increasing in magnitude as the air travels outward. When the air reaches the edge of the spinning disks, it is flung off of the disks and compressed against the walls of the pressure recovery chamber. The air is flung off of the disks at an angle according to the resultant velocity vector imparted to the air as depicted by FIG. 6. The rotation speed of the disks strongly influences the angle and magnitude of the resultant velocity vector shown in FIG. 6. The area between the edges of the disks and the walls of the pressure recovery chamber may be referred to as the pressure recovery involute, which may be shaped in a spiral as depicted in FIG. 4. After being flung off of the edges of the disks, the air travels towards the pump outlet along the pressure recovery involute and is further compressed by additional air being impelled off of the disks along the way and the expansion of the involute decelerating the air.

It will be appreciated that the present invention is not limited to the embodiments depicted in the drawings, and that the configuration of the pump 200 and the airbed environment 100 may be varied while remaining within the scope of the described principles. For example, the number and shape of the disks and the disk inlets may be varied, and although nine disks with six disk inlet holes are depicted in FIG. 5, the number and shape of the disks and the disk inlet holes may be varied. Another example is the configuration of the pressure recovery chamber housing, which does not necessarily require the two-piece cover and body configuration depicted, and which does not require the pump inlet and motor to be on the cover side while the pump outlet is on the body.

In further embodiments, portions of the pressure recovery chamber may be sealed or partially sealed off from each other to prevent gas recirculation within the pressure recovery chamber. By decreasing the amount of gas being recirculated within the pressure recovery chamber, the efficiency of the pump can be increased (e.g. achieving same amounts of flow and pressure with lower RPMs, less noise, and less power). One channel through which air recirculation occurs can be seen in FIG. 3, where gas flowing towards the outlet may recirculate through the space between the pressure recovery chamber housing cover 210 and the top disk of disks 230. One way of inhibiting this gas recirculation is to mount the motor 220 on the opposite side of the pressure recovery chamber, which would allow a ring to be raised up off the top disk and to be sleeved into an inlet bore, creating a conventional shaft and bore style seal. This design has the added benefit of reducing blockage of the inlet area caused by the arbor occupying space at the pump inlet 212, and further reduces the required size of the inlet hole, which allows a smaller seal to be used around the outside of the inlet hole. Another channel of gas recirculation can be seen in FIG. 4, where gas flowing near the pump outlet 213 may recirculate through the narrowest part of the pressure recovery involute and back around the pressure recovery chamber 240. Beyond constraining the distance between the edges of the disks and the pressure recovery chamber 240 at that point to a minimum (e.g. about 0.01"-0.02"), a sealing flap, such as a flap made out of Teflon, may be placed between the wall of the pressure recovery chamber 240 and the edges of the disks 230 to block the gas from recirculating.

Figure 7A:
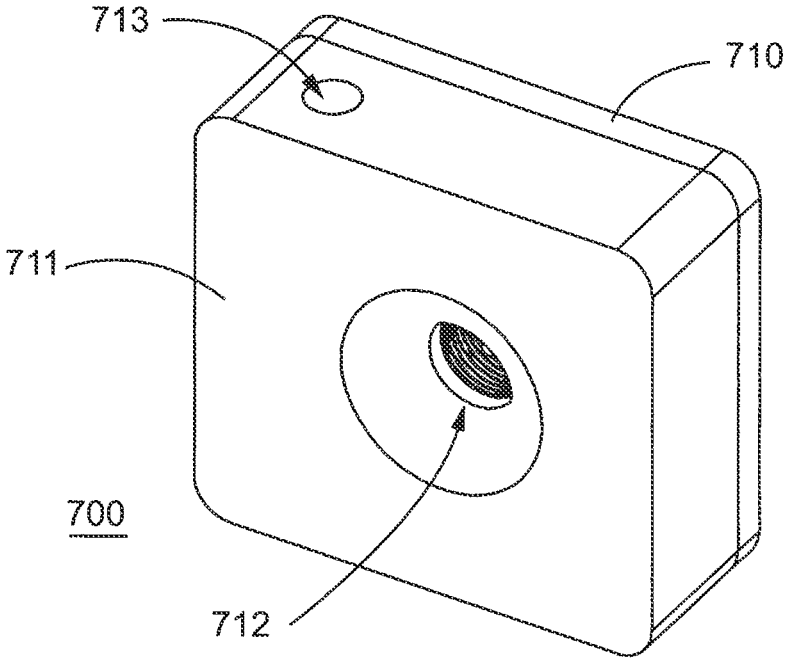
FIGS. 7A and 7B are 3D schematics of outside views of a pump.
Figure 7B:
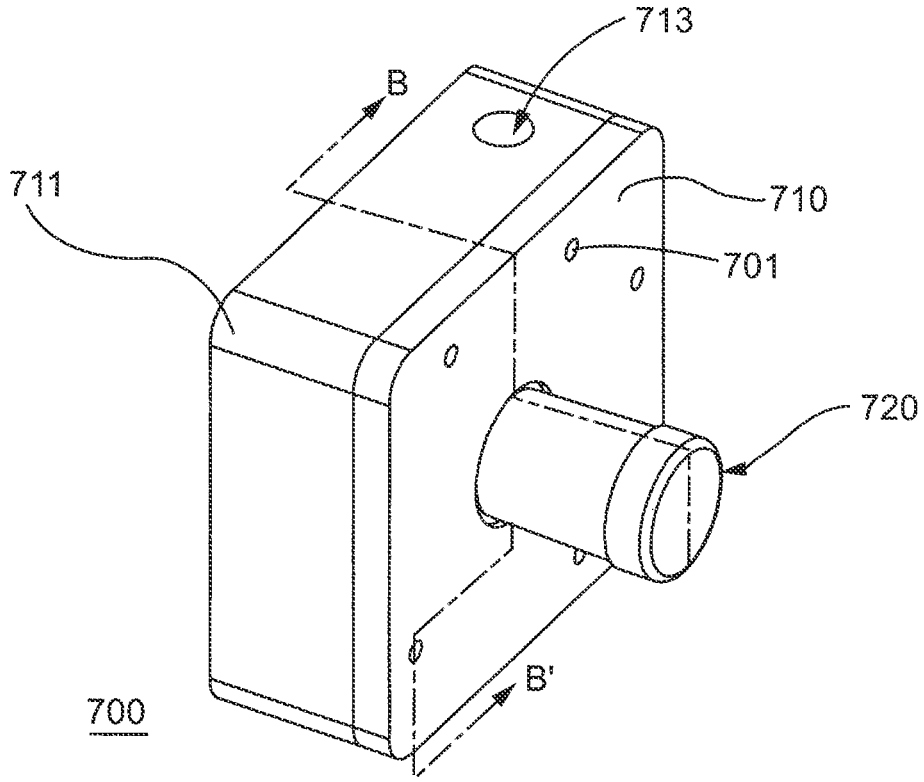

With further reference to the environment of FIG. 1, and turning more specifically to FIGS. 7A and 7B, outside views of another exemplary boundary-layer pump 700 used in another illustrative embodiment of the described principles are shown. The pump 700 includes a pressure recovery chamber housing, which further includes a pressure recovery chamber housing cover 710 and a pressure recovery chamber housing body 711. A pump inlet 712, which is bellmouth-shaped for improved gas intake rate, is provided on the pressure recovery chamber housing body 711, and a pump outlet 713 is provided on the pressure recovery chamber housing body 711. A motor 720 is attached to the pressure recovery chamber housing cover 710. It will be appreciated that motor standoff rods are not used in this exemplary embodiment. It will also be appreciated that placing the motor 720 on the side opposite from the pump inlet prevents the motor 720 from obstructing air flow through the pump inlet 712. FIG. 7B further depicts several attachment points 701 where, for example, screws can be placed to attach the pressure recovery chamber housing cover 710 to the pressure recovery chamber housing body 711.

Figure 8:
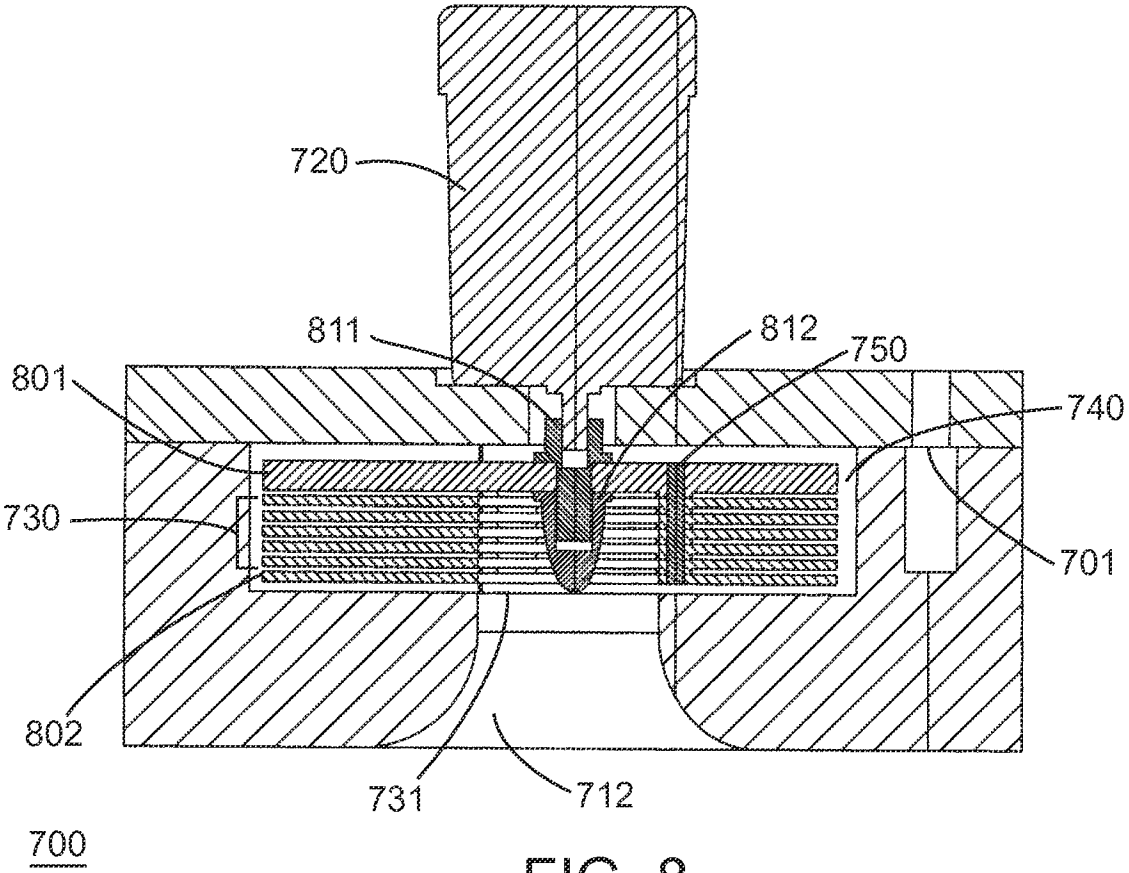
FIG. 8 is a schematic of a cross-sectional view of the pump depicted in FIGS. 7A and 7B.

FIG. 8 provides a cross-sectional view of the boundary-layer pump 700 along cross-sectional lines B-B' depicted in FIG. 7B. The motor 720 is connected to a disk assembly 811, which, together with collet nut 812, holds a base disk 801 that is furthest away from the pump inlet 712 in place. A disk array—including disks 730 and a "top" disk 802 (i.e., farthest from the base disk 801)—is attached to the base disk 801 by way of several disk retention pins 750 (for simplicity, only one disk retention pin 750 is depicted in FIG. 8), which will be explained in further detail with respect to FIG. 10. These pins cause the disk array to spin together with the base disk 801, which is spun by the motor 720 in combination with the disk assembly collet 811 and collet nut 812. It will be appreciated that, as shown in FIG. 8, the shape of the collet nut and uniform circular disk inlet areas 731 creates a tapered flow channel which reduces in area (from top disk 802 to base disk 801). This reduction in flow area provides a relatively more uniform flow speed through the disk array as each disk draws off an amount of air to compress. In an alternative embodiment, the base disk 801 and the disk array including disks 730 and top disk 802 are sonic-welded or otherwise bonded directly to a shaft of a motor 720, which would eliminate the need for a collet assembly. It will be appreciated that, in this alternative embodiment, the geometry of the disks would be appropriately modified to allow such welding or bonding.

Figure 12A:
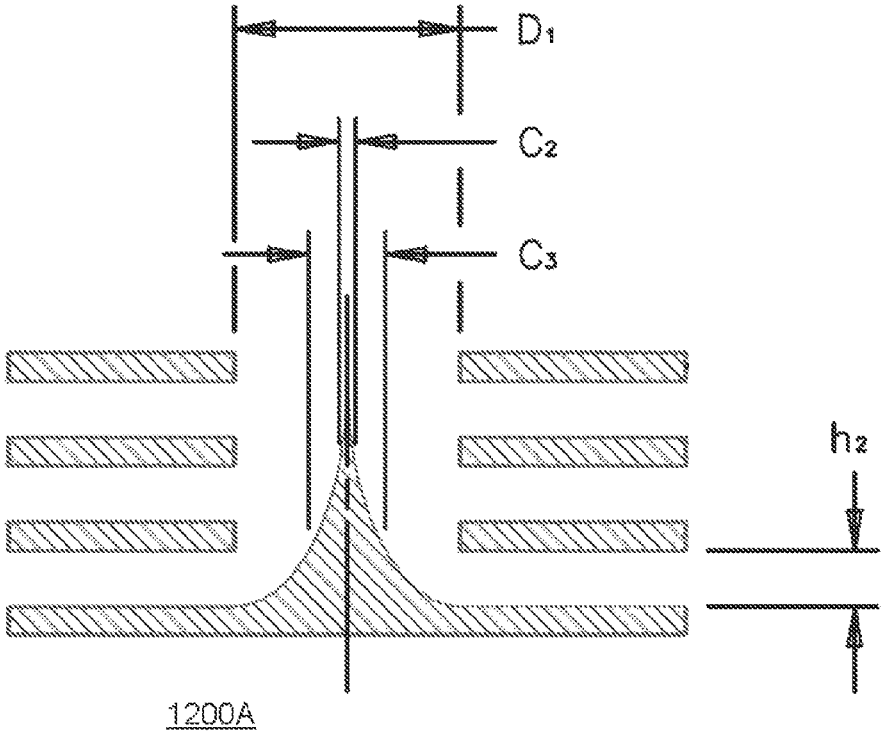
FIGS. 12A and 12B are simplified diagrams illustrating two exemplary disk array geometries.
Figure 12B:
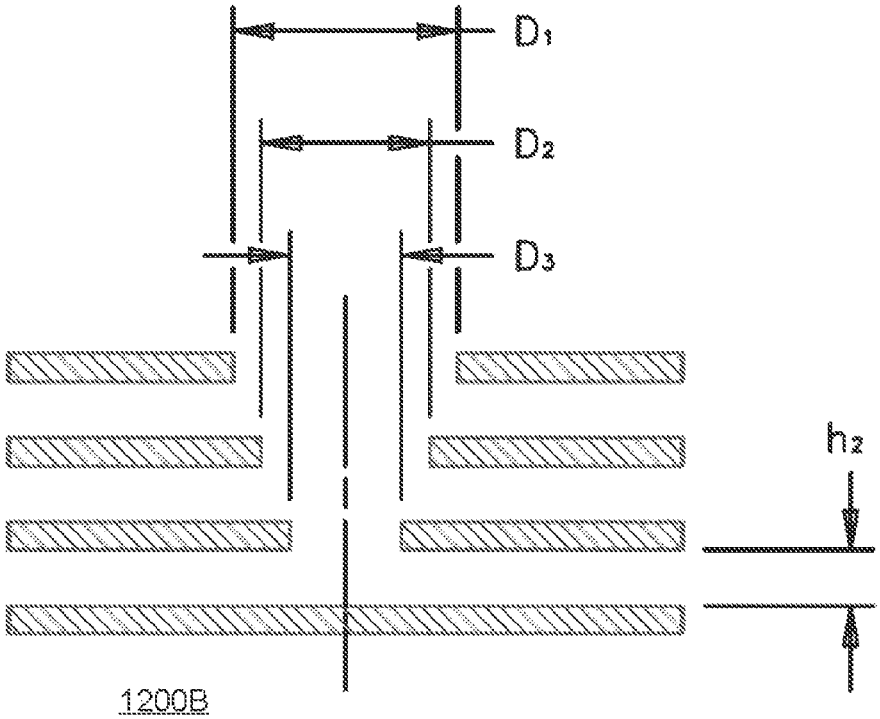

In one embodiment, the top disk 802 is identical to the other disks 730. In another embodiment, the top disk 802 has a ring raised off of it which is sleeved into an inlet bore, creating a conventional shaft and bore style seal that reduces recirculation of gas flowing towards the pump outlet 713 going over the top of the top disk 802 and back towards the pump inlet 712. In yet another further embodiment, all of the disks of the disk array have different sized disk inlet areas 731. For example, in an embodiment where the base disk 801 and the disk array are bonded directly to a motor shaft, the disk inlet areas 731 are configured such that there is a reduction in inlet hole area moving from the top disk 802 to the base disk 801, so as to achieve a tapered flow channel through the disk array (e.g., as depicted in FIGS. 12A-B below).

When the pump 700 is operated and the motor 720 is spinning, gas enters through the pump inlet 712, travels through a disk inlet area 731 on each disk in the disk array while also being drawn radially outwards along the disks into the pressure recovery chamber 740 and towards the pump outlet 713. For optimal performance, the motor 720 should be balanced with respect to the base disk 801 and the attached disk array. One exemplary way to balance the motor with the base disk 801 and the disk array is to selectively remove material from the base disk 801.

Figure 9:
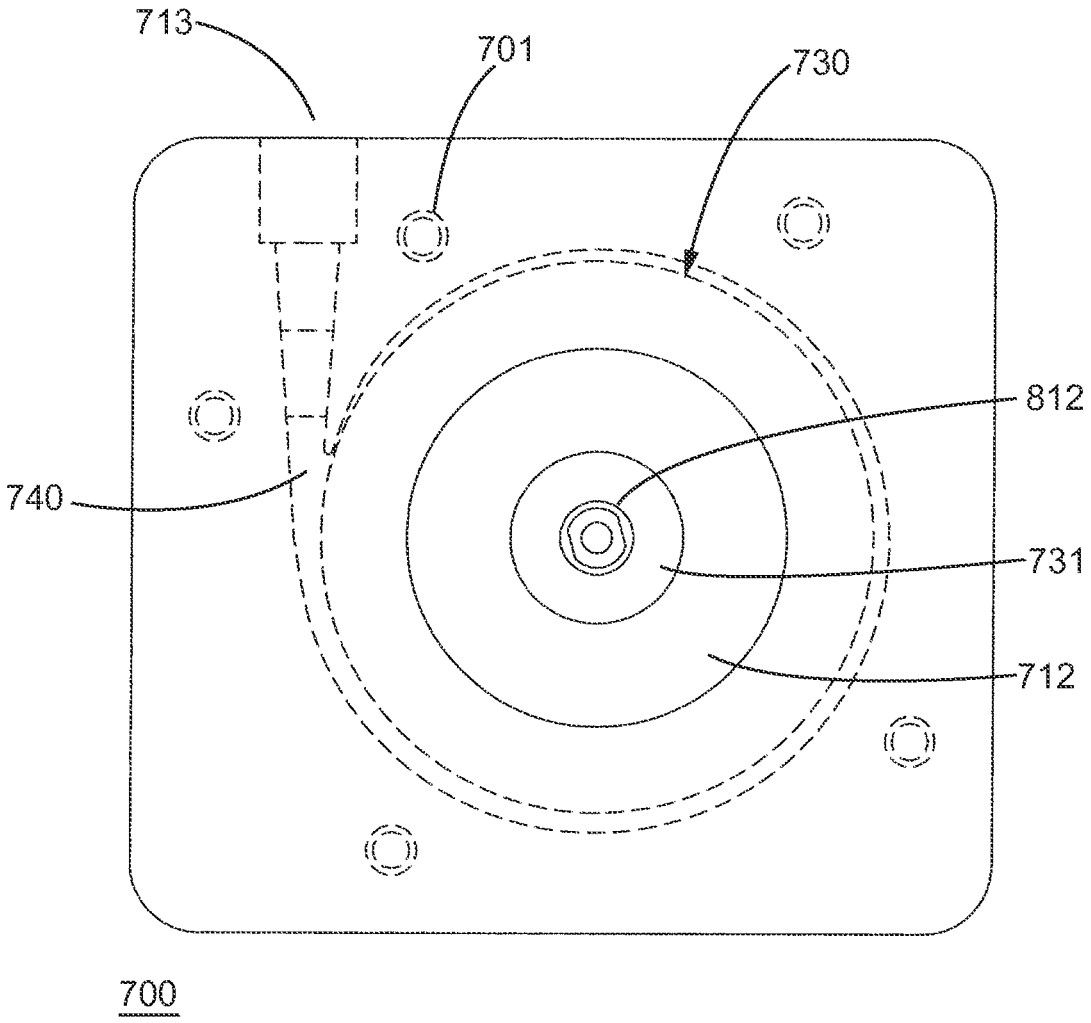
FIG. 9 is a schematic of a semi-transparent top-down view of the pump depicted in FIGS. 7A and 7B from the pump inlet side.

FIG. 9 provides a semi-transparent top-down view of the boundary-layer pump 700 from the side of the boundary-layer pump 700 having the pump inlet 712. FIG. 9 shows the relative sizes of the disks 730, pump inlet 712, disk inlet areas 731, and the collet nut 812. The space between the disks 730 and the walls of the pressure recovery chamber 740 form an involute shape that widens as it approaches the pump outlet 713. The pump inlet 712 has a bellmouth shape, the outer circumference of which is shown in FIG. 9. The tapered flow channel of the pump 700 is defined by the disk inlet areas 731 and the collet nut 812 as described above.

Figure 10:
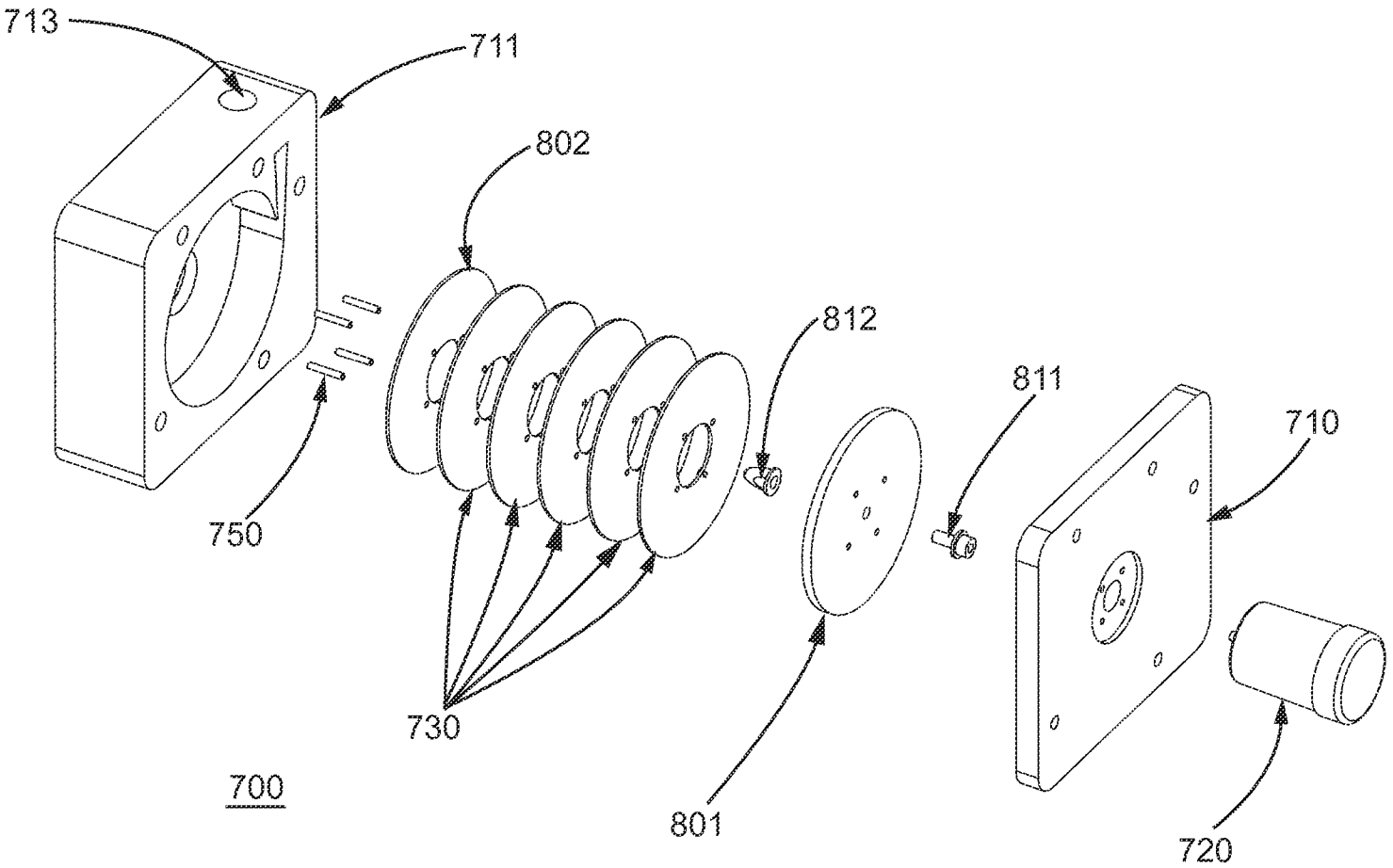
FIG. 10 is a 3D schematic of an exploded view of the components of the pump depicted in FIGS. 7A and 7B.

FIG. 10 provides a 3D schematic of an exploded view of the components of the boundary-layer pump 700. The motor 720, pressure recovery chamber housing cover 710, disk assembly collet 811, base disk 801, collet nut 812, disks 730, top disk 802, disk retention pins 750, pressure recovery chamber housing body 711, pump outlet 713, and the order in which these components are arranged in one embodiment are depicted. It will be appreciated that the disk retention pins 750 correspond to holes in the disks 730, closest disk 802, and base disk 801 and serve to hold the disk array to the base disk 801 and to transmit torque to the disk array. The disk retention pins, for example, may be glued to the disks or, in another example, may be replaced by a series of molded posts an receivers that are sonic welded together in creating the disk array and base disk.

The principles of gas flow through the pump 700 shown in FIGS. 7-10 are similar to those described above with respect to the pump 200 with respect to FIGS. 2-6. Gas enters through the pump inlet 712, travels through and along the disks of the disk array into an involute-shaped pressure recovery chamber 740, and goes out through the pump outlet 713.

Although pumps utilizing boundary-layer effects, also known as Tesla pumps, may be known to those familiar in the field of fluid mechanics and pumping technologies, these types of pumps have conventionally only been commercially implemented in large-scale liquid pumping applications, at least in part because Tesla pumps are not prone to the cavitation problems experienced with other types of liquid pumps (an advantage that is inapplicable to the pumping of a gas). The drastic difference between the viscosities of liquids and gases, which is on the scale of two orders of magnitude (at 20° C., air has a kinetic viscosity of 1.83 E-5 Pa-s while water has a kinetic viscosity of 1.00 E-3 Pa-s), and the size constraints inherent to an airbed environment (liquid pumps often use disks with diameters of at least 12-18 inches, which would be too large to be commercially feasible for airbed applications) introduce serious complications into the design of a boundary-layer pump for an airbed environment. Furthermore, the relatively low pressures used in airbed environments require precise pressure control.

Given a relatively small disk size (e.g. approximately 3.7 inch diameter in one embodiment), the number of revolutions per minute (RPMs) has to be very large to generate the amount of flow and pressure desired in an airbed environment (e.g. approximately around 21,000 RPMS in one embodiment). Introducing such a high number of RPMs introduces vibration and longevity issues, as the boundary-layer pump loses efficiency and generates noise due to the vibrations, and the components of the pump affected by the high RPMs (such as the bearing at the end of the shaft) are subject to wear-and-tear considerations. The performance of the boundary-layer pump in the airbed environment is further sensitive to the relationship between the disk diameter, number of disks, operable range of RPMs and the shape/curvature of the pressure recovery involute. Furthermore, for best performance, the shape of the pressure recovery involute should be carefully matched to the disk diameter, disk quantity and operating RPM of the boundary-layer pump.

To determine an efficient geometry for the disk inlet holes and the pressure recovery involute, an iterative calculation based on Bernoulli's equation may be performed. While Bernoulli's equation has certain limitations which must be taken into consideration, it is very useful for certain aspects of disk sizing and determining the geometry of the pressure recovery chamber. It becomes less accurate at relatively high flow rates and pressures when compressibility effects are more significant, but it is still useful as a starting point in an iterative process of calculating how large the inlet area on the disks should be. Bernoulli's equation which assumes (1) laminar flow (non-turbulent), (2) adiabatic flow (no heat transfer), (3) ideal inviscid behavior (no internal heat generation), (4) incompressibility (generally true for flow velocities less than Mach 0.3), (5) a stream line (looking at same "particle" of fluid in two locations), and (6) constant gravity field—is provided by the following mathematical relationship:

$$\frac{v^2}{2} + gz + \frac{p}{\rho} = \text{constant}$$

where v is the fluid flow speed at a point on the streamline, g is the acceleration due to gravity, z is the elevation of the point above a reference plane, with the positive z-direction pointing upward, p is the pressure at the chosen point, and ρ is the density of the fluid at all points of the fluid. In the context of two different stations, by setting the two stations equal to one another (continuity) and adding the equation for flow rate (Q), $$\begin{cases} Q = v_1 A_1 = v_2 A_2 \\ p_1 - p_2 = \frac{\rho}{2}(v_2^2 - v_1^2), \end{cases}$$

$$Q = A_1 \sqrt{\frac{2(p_1 - p_2)}{\rho\left(\left(\frac{A_1}{A_2}\right)^2 - 1\right)}} = A_2 \sqrt{\frac{2(p_1 - p_2)}{\rho\left(1 - \left(\frac{A_2}{A_1}\right)^2\right)}},$$

and then further incorporating the energy increase provided by the disk array to the original statement of Bernoulli's equation, $$p_{in}/\rho + v_{in}^2/2 + gz_{in} + w_{shaft} = p_{out}/\rho + v_{out}^2/2 + gz_{out} + w_{loss}$$

where $w_{shaft}$ is the net shaft energy in per unit mass and $w_{loss}$ is the loss due to friction, a useful system of equations may be obtained with which to iteratively solve for an appropriate size of the inlet hole and geometry of the pressure recovery chamber. It will be appreciated that, to simplify the calculation, the loss due to friction may be ignored, which may produce some deviation between theoretical and actual results.

An iterative process that may be used is as follows:

(1) A target flow rate (Q) may be chosen based on design requirements and a first station, "station 1" may be set as the inlet to the pump and a second station, "station 2," may be set as the exit to the pressure recovery involute.

(2) A starting pressure and compression ratio are estimated to calculate $p_{out}$. For example, the starting pressure may be assumed to be at atmospheric, and a value such as 1.14 may be chosen as an estimation of the compression ratio achieved by the disk array. It will be appreciated that, depending on the design of the disk array and RPM, a wide range of compression ratios may be possible.

(3) The power added to the system via the motor may be measured experimentally or calculated based upon the expect Q, p2/p1, and assumed efficiency of the Tesla array. For example, 60% is a generally accepted number for Tesla pump efficiency.

(4) Using conventional performance equations and charts found in references such as Karassik et al.," Pump Handbook," McGraw-Hill (2001) (see Chapter 2 and FIGS. 8, 12 and 20), which is hereby incorporated by reference in its entirety entireties, the Q, p2/p1, fluid density and input power may be used to look up the recommended final A2 area of the involute. However, given that the performance charts are based on pump designs that are significantly larger than what would be suitable for the airbed industry, the values given by the tables may be extrapolated to arrive at an estimation more suitable for relatively small pump designs. A better reference that may be used is Ametek Technical & Industrial Products, "A: Low Voltage Brushless DC Blowers," Ametek Products Catalog: Blowers (see "3.0 (76 mm) BLDC Low-Voltage Blower"), available at http://www.ametektip.com/index.php?option=com_catalog&view=catalog, which is incorporated herein by reference in its entirety, which pertains to pump designs that are smaller than those described by Karassik et al. Using the performance chart from a reference such as the Ametek catalog thus provides a closer starting point for subsequent estimations and calculations.

(5) Using Q, p1, p2, A2, and input power, A1 may be calculated using Bernoulli's equation, where A1 is the minimum area for the holes down the middle of the disks.

Figure 11A:
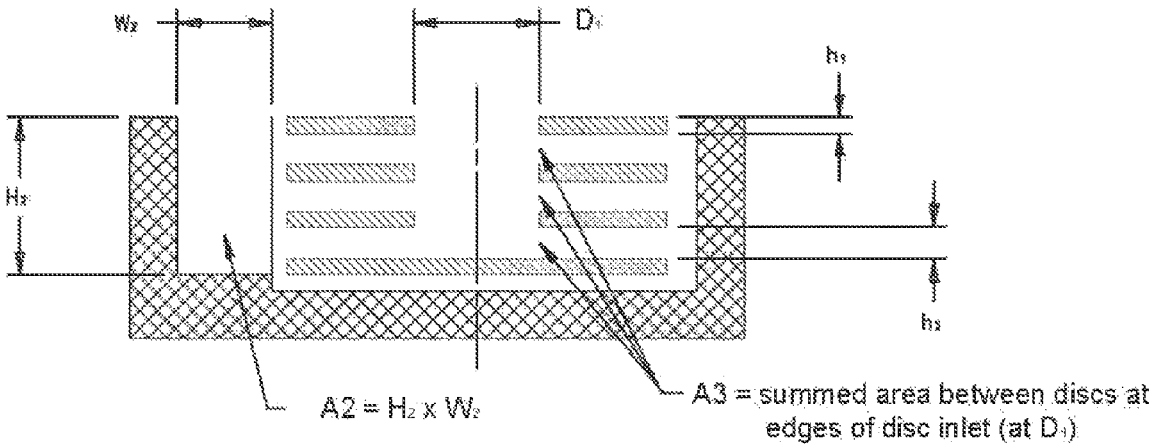
FIGS. 11A and 11B are diagrams showing a simplified set of disks and a pressure recovery involute illustrating the dimensions used in performing iterative calculations to determine the geometry of the disk inlet holes and the pressure recovery involute.
Figure 11B:
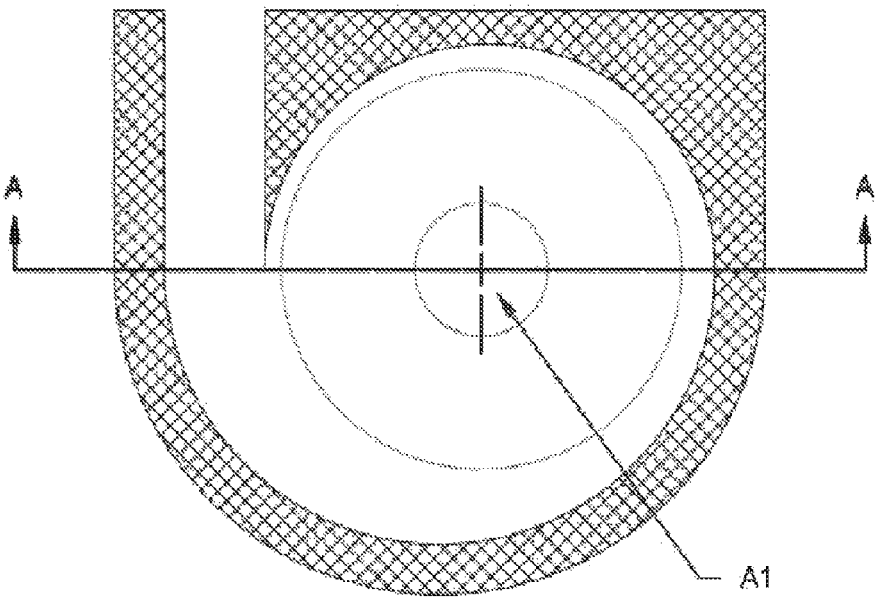

(6) Using A1, a minimum cumulative area at the inlet to the gaps between the disks may be determined as shown in diagram 1100B of FIG. 11B. For example, in a single center hole design, A1 may be used to give the diameter $D_1$ of the center hole. The circumference of the center hole may then be multiplied by the gap height between the disks and the number of disks to provide the cumulative area A3 at the inlet to the gaps between the disks. For example, for a disk array design with uniform disk inlet area with three gaps between disks as shown in diagram 1100A of FIG. 11A, A3=$D_1\pi\times h_2\times 3$. This cumulative area A3 should be slightly greater than or equal to A1.

In certain embodiments, the disks may have a tapered hole style layout as shown in diagram 1200B of FIG. 12B. With a tapered hole style layout, the calculation proceeds on a disk-by-disk bas$_i$s, with the net area of each gap subtracted from the area of the hole in the gap's "ceiling" disk. The reduced area is used to calculate the required area of the hole in the gap's "floor" disk. By repeating this process until the inlet hole in the "ceiling" disk is roughly equal to the inlet gap area in the last disk. For example:

$$D_1\pi \times h_2 \cong \left(\frac{D_1^2}{4}\pi - \frac{D_2^2}{4}\pi\right) \text{ and}$$

$$D_2\pi \times h_2 \cong \left(\frac{D_2^2}{4}\pi - \frac{D_3^2}{4}\pi\right)$$

and so on.

Another alternative design is shown in diagram 1200A of FIG. 12A, which is similar to the disk array layout of the boundary-layer pump 700 discussed above with respect to FIGS. 7A-10. The layout shown in FIG. 12A effectively achieves the same result as the layout shown in FIG. 12B, but the layout shown in FIG. 12A provides certain advantages with respect to ease of manufacture and helping to induce radial flow. It will be appreciated that in FIGS. 11A-B and 12A-B, the simplified depiction of the cross-section of the disks omits the shaft and the parts of the disks connected to the shaft.

(7) Finally, using the summed disk and gap heights and A2, the maximum gap $W_2$ between the involute and the disk array may be calculated as shown in FIG. 11A. It will be appreciated that, as this is an iterative process involving estimations, one skilled in the art would be able to reach a variety of values for the set of parameters (A1, $D_1$, $h_2$, $W_2$, etc.) defining the geometry of the pressure recovery involute and the disk arrays in accordance with the principles described herein.

It will also be appreciated that the calculations above are based on an assumption that the flow rates do not exceed about Mach 0.3 to Mach 0.5. However, it will be appreciated that even though the quality of prediction decreases at higher speeds, the calculations above may still be used for a first pass sizing estimation for the pump dimensions. In any event, accurately predicting the behavior of such boundary-layer pump designs, whether at relatively low or relatively higher speeds, generally requires some degree of iterative testing using physical models. To give an example, at 21 k RPM, a 3.7" diameter disk's perimeter is moving at Mach 0.3. In actual experiments with 3.7" disks rotating at 21 k RPM, the calculations described above were determined to work well for predicting actual performance (within about 15% of theoretical results) and for predicting design changes that improve actual performance.

As mentioned above, various disk designs may be used in embodiments of the present invention, ranging from relatively simple single-sized center hole designs as shown in FIGS. 11A-B and tapered hole designs shown in FIGS. 12A-8, to more complex disk designs such as disks with overall tapering (i.e. disks with overall different diameters). In further embodiments, the surface texture of the disks may also be varied (e.g., disks having smooth surfaces versus disks with embedded splines or waves). For example, the roughness of a disk is a significant variable in terms of increasing flow at relatively low pressures. At a given number RPMs and back pressure, a smooth disk, such as a CD (Ra=12), produces more flow than a rougher disk with 100 grit sandpaper glued to its surface (Ra=150), while the rougher disk generates more pressure. However, this effect diminishes as the flow rate approaches zero.

Thus, the design of boundary-layer pumps in the airbed environment requires a large number of unique considerations: the extremely low viscosity of air, the size constraints of an airbed environment, the pressure and flow required for an air mattress, the RPMs and disk size necessary to achieve those requirements, the effect of the required RPMs on the pump components, and the relationship between the radial velocity of the impelled air and the shape of the pressure recovery chamber. It will be appreciated that variables such as disk size, spacing, texture, number, and speed may be put together in multiple offsetting ways (e.g., more disks with smaller disk size versus less disks of a bigger disk size) to achieve a configuration that is appropriate for airbed applications.

In one trial involving an embodiment that used ten 3.7 inch diameter disks and the pressure recovery involute shape depicted in FIG. 4, a boundary-layer pump operating at about 21,000 RPMs on about 80 Watts of power was able to output approximately 0.83 psi and more than 100 L/min in flow. A conventional squirrel-cage blower tested under the same conditions produced 20-30% less pressure and much less flow. In other trials involving a comparison of an implementation of boundary-layer pump 700 depicted in FIGS. 7-10 to commercially available pumps, the boundary-layer pump 700 was also shown to outperform those commercially available pumps with respect to target flow rates and pressures for airbed applications.

Figure 13:
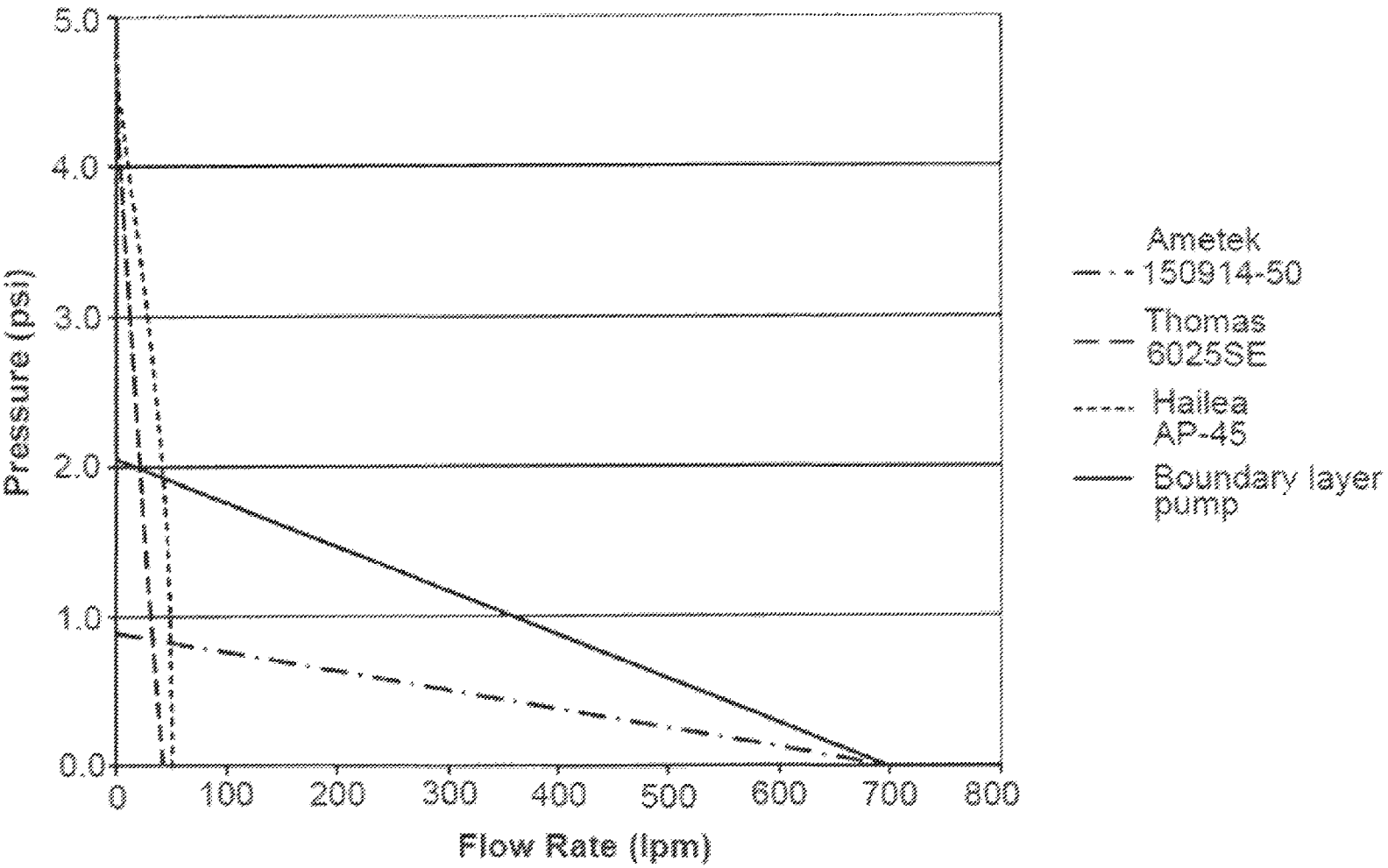
FIG. 13 is a graph showing the results of experimental trials estimating the performance of a boundary-layer pump design relative to commercially available pumps.

Further, FIG. 13 is a graph 1300 depicting an estimated comparison between boundary-layer pump designs and commercially available pumps. The Ametek 150914-50 is an expensive high-end squirrel cage blower. The Thomas 6025SE and Hailea AP-45 are dual-acting diaphragms pumps. As can be seen from graph 1300, the boundary layer pumps are able to achieve much higher flow rates at target pressures suitable for airbeds (e.g., approximately from 0.1 to 1.5 psi). The estimated comparison was based on several trials involving power-limited motors (to compare the efficiency of each design, the same power-limited motor was used in each pump tested), and the graph 1300 is intended to show a performance envelope that is possible for a boundary-layer pump using only a single disk array to show that such a performance envelope is not possible for commercially available pumps using the same motor. The flow rate axis is governed by the amount of power available (and also the number of discs for a boundary-layer pump design). Thus, it will be appreciated that the graph 1300 shows that, when using a motor of the same power, the boundary layer pump outperforms commercially-available pumps, and that at different motor power values, the values shown in the graphs may change (but the boundary-layer pump is expected to outperform the commercially-available pumps at other motor power values as well).

In further embodiments, the previously described boundary-layer pumps are modified so as to be capable of performing a powered dump operation. Conventionally, when a user wishes to reduce the pressure in an air mattress, the control unit opens and closes valves such that the appropriate air mattress chamber or chambers is or are connected to an exhaust that vents out gas from the air mattress. During this venting, the pump remains off. However, with a powered dump operation, the described boundary-layer pumps are modified such that the pumps are turned on and used to decrease the pressure in the appropriate air mattress chamber or chambers more quickly (relative to venting).

Figure 14B:
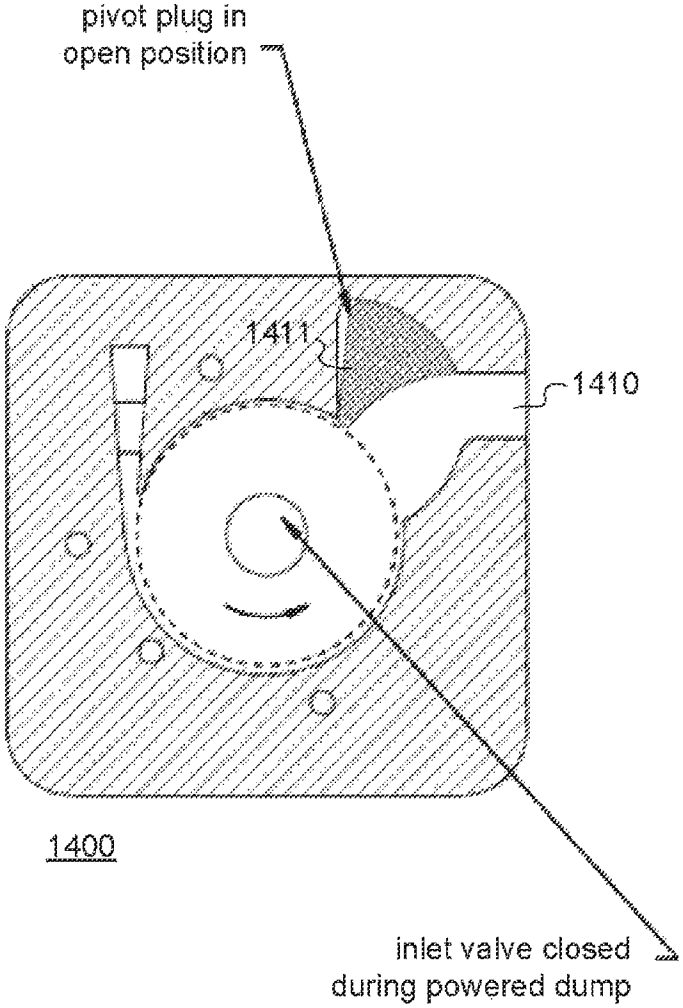
FIGS. 14A and 14B are cross-sectional views of a pump with a pivot plug configured to perform filling operation and powered dumping, respectively.
Figure 14A:
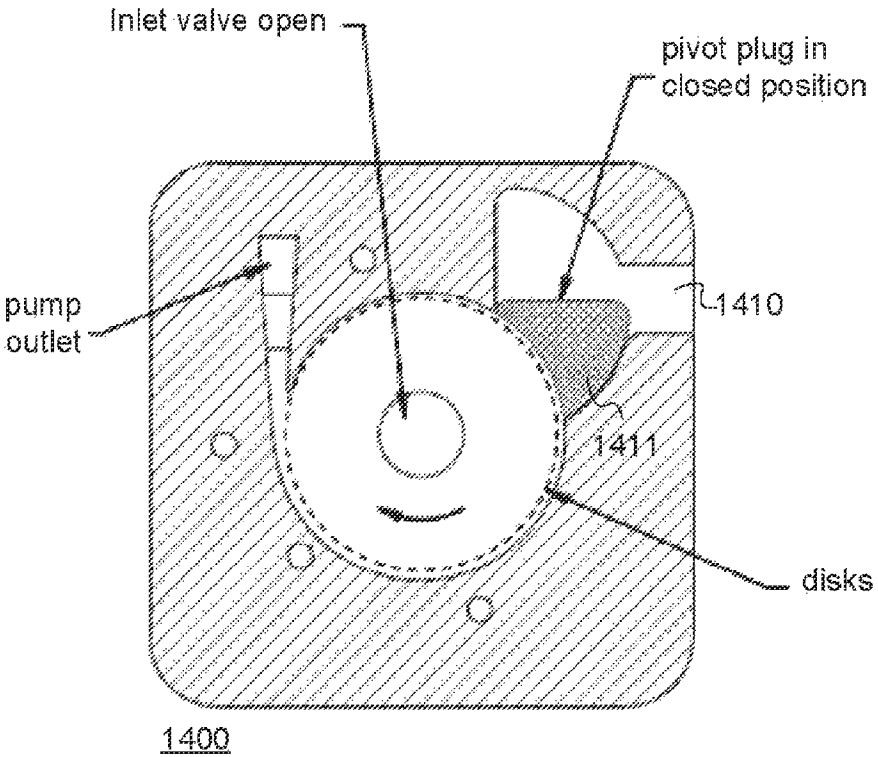

FIGS. 14A and 14B depict an exemplary boundary-layer pump 1400 capable of powered dump. The boundary-layer pump 1400 is similar to the boundary-layer pump 700 depicted in FIGS. 7-10. The direction of rotation of the shaft and disks can be reversed, for example, by reversing the polarity of the electric current being supplied to the motor, with rotation in one direction (as depicted in FIG. 14A) corresponding to filling operation and rotation in the other direction (as depicted in FIG. 149) corresponding to powered dump operation. It will be appreciated that there are other ways of reversing the direction of operation of the motor, for example, by adjustment of a brushless motor controller. As shown in FIGS. 14A and 14B, the pressure recovery housing of pump 1400 includes an exhaust outlet 1410 in addition to the pump inlet and the pump outlet. In this embodiment, a pivot plug 1411 is positioned at the exhaust outlet 1410 such that, in a first position during filling operation, it forms part of the wall of the pressure recovery chamber and isolates the pressure recovery chamber from the exhaust outlet (as shown in FIG. 14A), and, in a second position during powered dump operation, it is positioned an as to allow gas entering the pressure recovery chamber to be expelled outwards through the exhaust outlet 1410.

It will be appreciated that, during the powered dump operation, an inlet valve associated with the pump (e.g. a flapper valve) is closed, preventing gas in the atmosphere from entering the boundary-layer pump 1400 during the powered dump operation. When the exhaust outlet 1410 is opened (through the pivot plug 1411 changing positions) and the inlet valve is closed, gas moves from the relatively high pressure region of the pump outlet into the pressure recovery chamber. The relatively low pressure region at the exhaust outlet 1410 combined with the rotation of the disks in the reverse direction (as shown in FIG. 14B), which imparts a velocity profile to gas pushed onto the disks by the relatively high pressure at the pump outlet, causes the gas to move from the pump outlet to the exhaust outlet 1410 during the powered dump operation of the boundary-layer pump 1400.

Figure 15B:
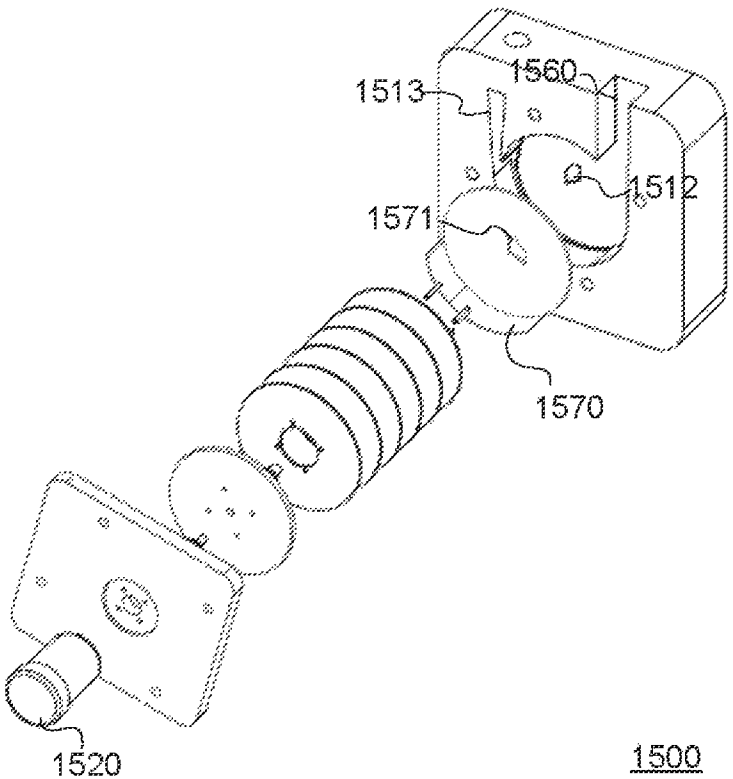
FIGS. 15A and 15B are 3D schematics of exploded views of a pump with an adjustable sheath configured to perform filling operation and powered dumping, respectively.
Figure 15A:
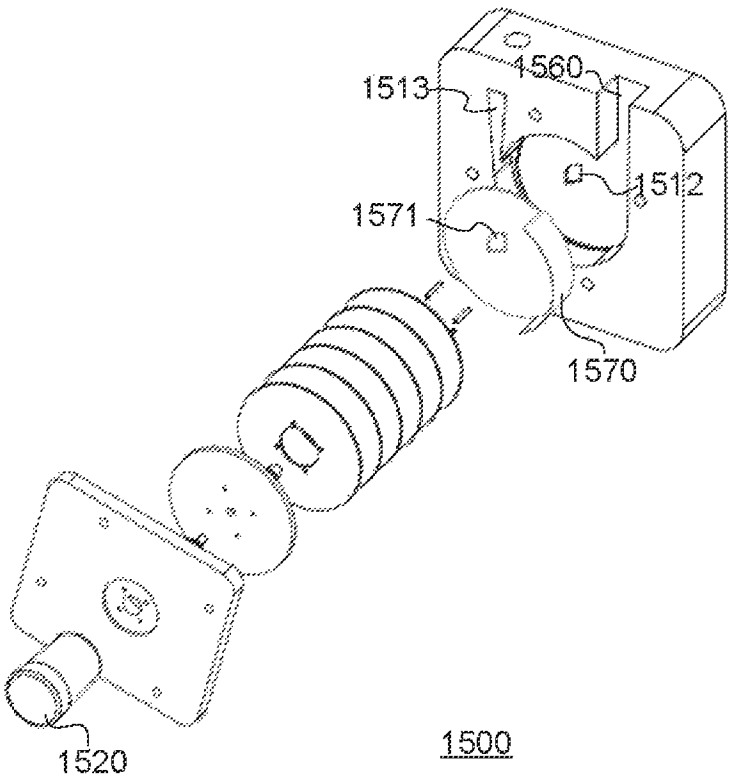
Figure 15D:
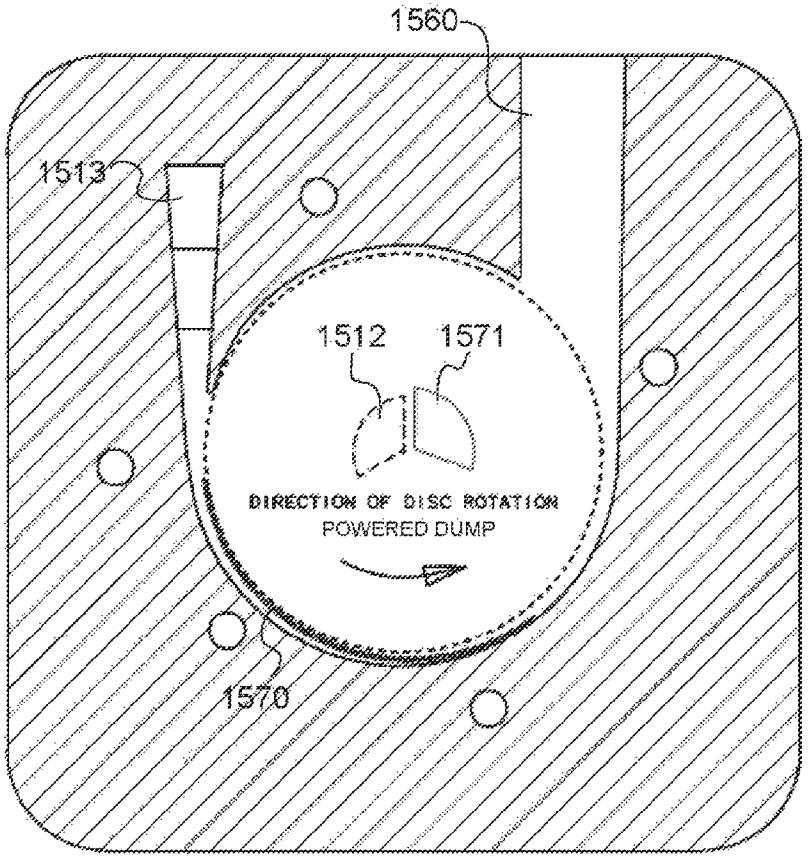
FIGS. 15C and 15D are cross-sectional views of the pump depicted in FIGS. 15A and 15B.
Figure 15C:
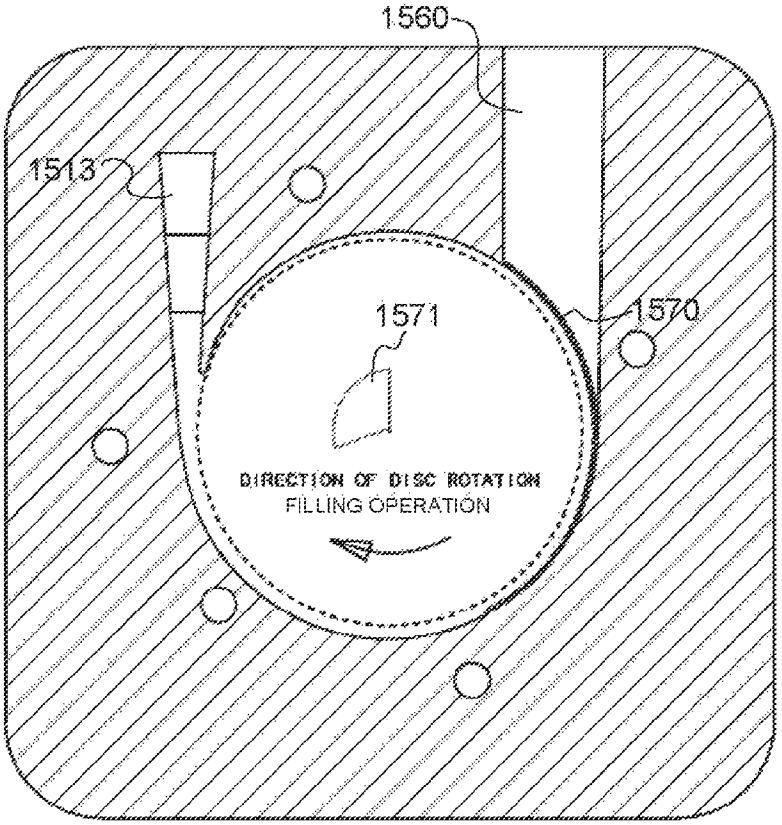

FIGS. 15A and 15B depict another exemplary boundary-layer pump 1500 capable of performing a powered dump operation. Pump 1500 is similar to pump 700 of FIGS. 7-10, but with a pump inlet 1312 that is matched to an adjustable sheath 1570. The boundary-layer pump 1500 also has a reversible motor 1520 and an exhaust outlet 1560. As shown in FIG. 15A, which is an exploded view of the components of the pump 1500 when the adjustable sheath 1570 is in position for a filling operation, the adjustable sheath 1570 is positioned such that the exhaust outlet 1560 is cut off from the pressure recovery chamber of the pressure recovery housing by the adjustable sheath 1570, and a window 1571 of the adjustable sheath 1570 is aligned with a similarly-shaped pump inlet 1512. Thus, when the motor 1520 is operated during filling operation, gas enters through the pump inlet 1512 and the window 1571, travels along a pressure recovery involute formed by the pressure recovery chamber in combination with the adjustable sheath 1570, and exits through the pump outlet 1513. Another view of the adjustable sheath 1570 in this position for filling operation is shown in FIG. 15C, which depicts a cross-section of the pump 1500 during filling operation. It will be appreciated that the size, shape, and configuration of the pump inlet 1512 and the window 1571 can be varied. The depiction of the pump inlet 1512 and the window 1571 in FIGS. 15A-D are merely exemplary. In other variations, the pump inlet 1512 and the window 1571 can be larger or smaller, can be a different shape, or can have a configuration involving multiple inlets and windows.

Turning to FIG. 15B, the pump 1500 is shown in a powered dump operation. In order to perform powered dump operation, the adjustable sheath 1570 is shifted into a powered dump position where the sheath 1570 is positioned such that the exhaust outlet 1560 is now exposed to the pressure recovery chamber, and the window 1571 of the adjustable sheath 1570 is no longer aligned with the pump inlet 1512, cutting off the pump inlet 1512 from the pressure recovery chamber. The direction of rotation of the motor 1520 is reversed in the powered dump mode. Thus, gas enters the pressure recovery chamber from an air mattress through the pump outlet 1513, is drawn through the pressure recovery chamber circumferentially by the spinning disk array, and is expelled through the exhaust outlet 1560. As shown in FIG. 15D, which depicts a cross-section of the pump 1500 during powered dump operation, the geometry of the pressure recovery chamber is reversed during powered dump operation, creating a pressure recovery involute that widens as it approaches the exhaust outlet 1560.

Figure 16B:
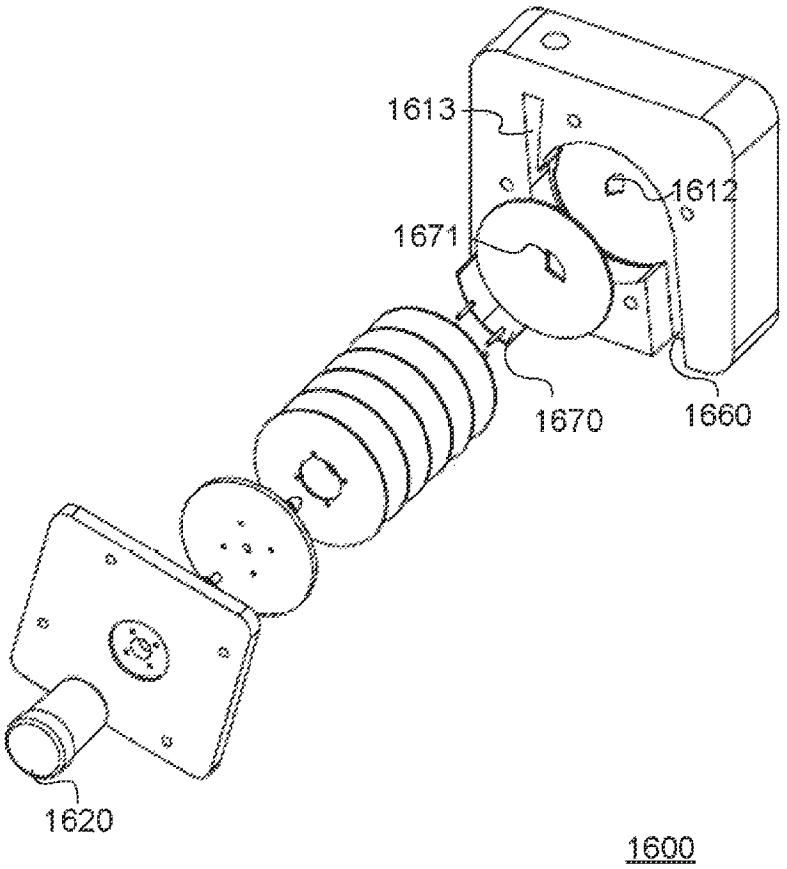
FIGS. 16A and 16B are 3D schematics of exploded views of another pump with an adjustable sheath configured to perform filling operation and powered dumping, respectively.
Figure 16A:
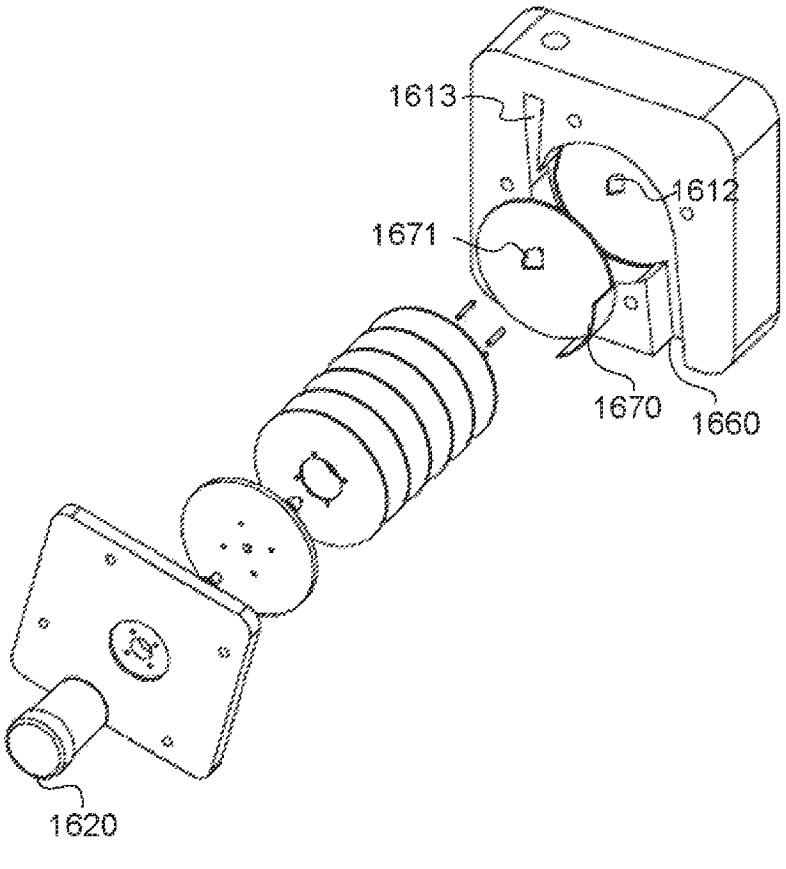
Figure 16D:
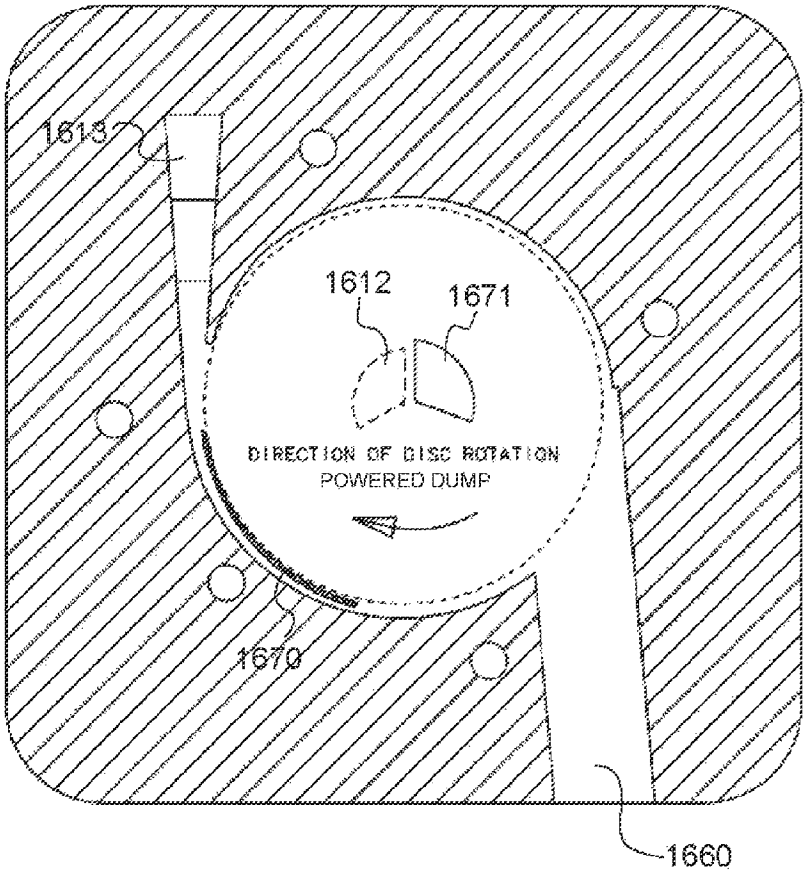
FIGS. 16C and 16D are cross-sectional views of the pump depicted in FIGS. 16A and 16B.
Figure 16C:
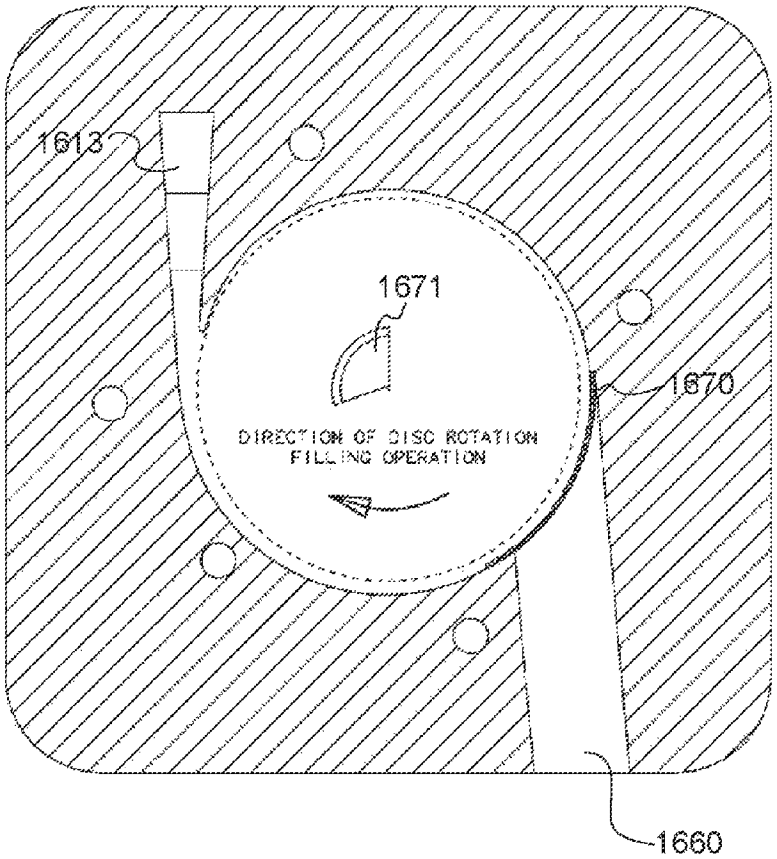

It will be appreciated that the pump design shown in FIGS. 15A-D utilizes a reversible motor. In another further embodiment, another exemplary boundary-layer pump 1600 capable of performing a powered dump operation with a non-reversible motor is shown in FIGS. 16A-16D. The boundary-layer pump 1600 is similar to the boundary-layer pump 1500 depicted in FIGS. 15A-15D and includes a motor 1620, pump inlet 1612, pump outlet 1613, exhaust 1660, adjustable sheath 1670, and a window 1671 on the adjustable sheath 1670. However, the motor 1620 is anon-reversible motor and the exhaust 1660 is positioned differently with respect to the pressure recovery chamber relative to the design of pump 1500. FIG. 16A is a schematic of an exploded view of the pump 1600 with the sheath in position for filling operation, while FIG. 16B is a schematic of an exploded view of the pump 1600 with the sheath in position for powered dumping. FIGS. 16C and 16D provide cross-sectional views of the pump 1600 with the sheath in position for fining operation and in position for powered dumping, respectively.

Thus, it will be appreciated that exemplary boundary layer pumps 1400, 1500, and 1600 are different configurations of boundary-layer pumps that are able to achieve powered dumping. Each configuration is suitable for different applications based on cost and performance requirements, as the differences between each design represents certain tradeoffs between complexity, cost, and performance. For example, the boundary-layer pump 1600 depicted in FIGS. 16A-16D utilizing a non-reversible motor produces slightly less negative pressure during powered dumping than the boundary-layer pump 1500 depicted in FIGS. 15A-15D which utilizes a reversible motor. However, because the boundary-layer pump 1600 uses a non-reversible motor, it also comes with slightly lower cost and is less complex.

Furthermore, while FIGS. 14A-16D show various embodiments of pump-driven configurations for achieving powered dumping, there are also manifold-driven configurations that allow powered dumping that will be discussed in further detail below in the context of various manifold and housing configurations utilizing boundary-layer pump designs.

Figure 17:
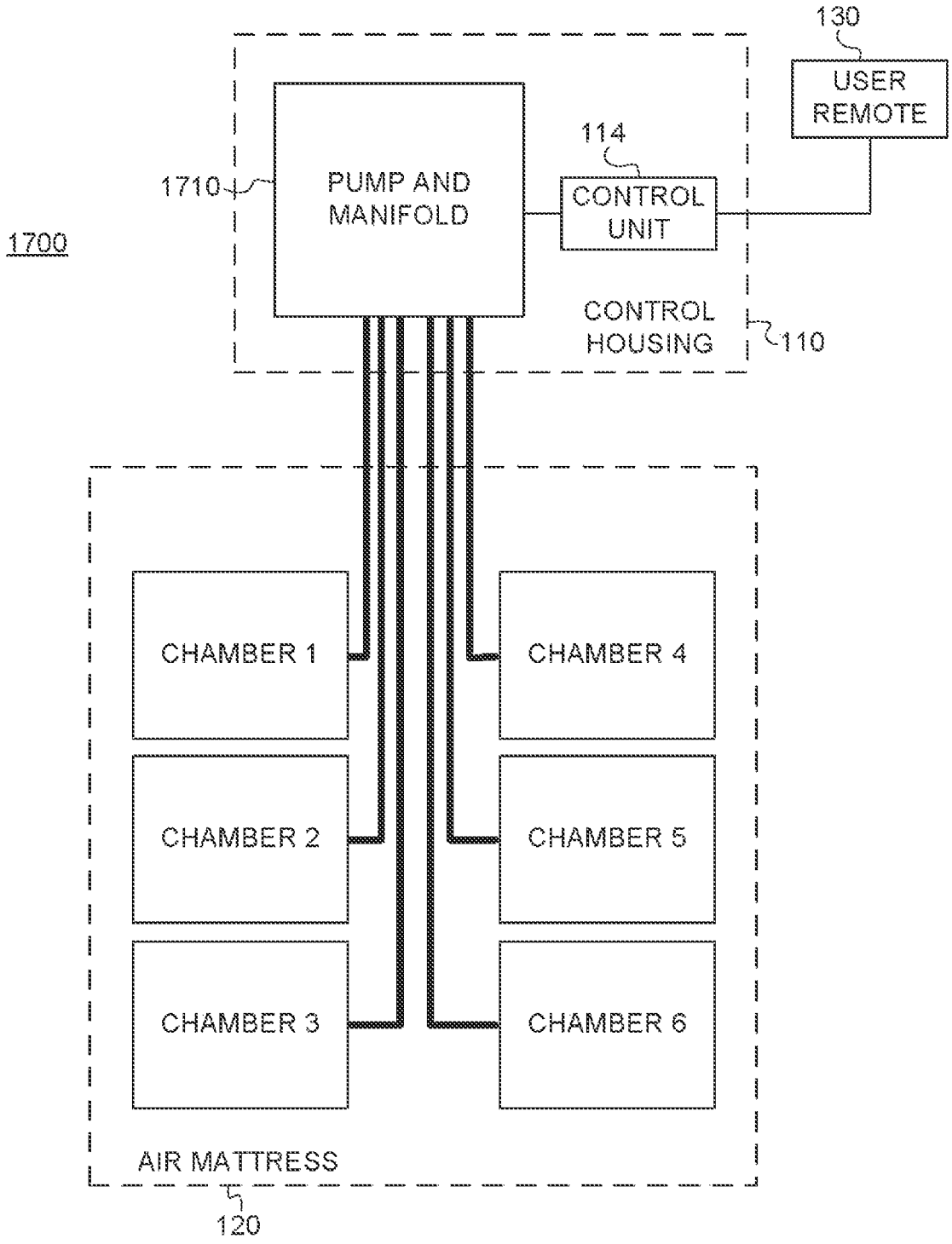
FIG. 17 is a block diagram of another airbed environment useable in embodiments of the described principles.

FIG. 17 depicts a variation 1700 of the exemplary airbed environment 100 from FIG. 1 in which the invention may operate, wherein the pump and manifold are integrated into a single pump and manifold housing (hereinafter "integrated housing") 1710. The air mattress 120 is further depicted with six chambers instead of two chambers, although it will be appreciated that both environments 100 and 1700 may include an air mattress 120 with any number of chambers. Appropriate connections between the integrated housing 1710 and the six chambers are shown, with one connecting tube for each chamber. In another embodiment, instead of having six connecting points at the integrated housing 1710 (corresponding to the number of manifold outlets), the integrated housing 1710 may have a different number, such as four outlets, to accommodate six chambers. In this embodiment, the tubes connected to two of the outlets may be divided by a splitter such that one outlet may service two chambers (e.g. chambers 1 and 4 and chambers 4 and 6 being serviced by the same outlet via a splitter). It will be appreciated that the integrated housing 1710 of airbed environment 1700 of FIG. 17 and the manifold 112 of airbed environment 100 of FIG. 1 may be configured with any number of outlets connected to any number of chambers within an air mattress by appropriate connections and splitters. It will further be appreciated that an integrated housing 1710 or manifold 112 with, for example, six outlets may be used together with an air mattress with, for example, two chambers, as unused outlets could merely remain closed. Thus, a single control housing 110 is readily adaptable for use with a variety of air mattresses.

Figure 18:
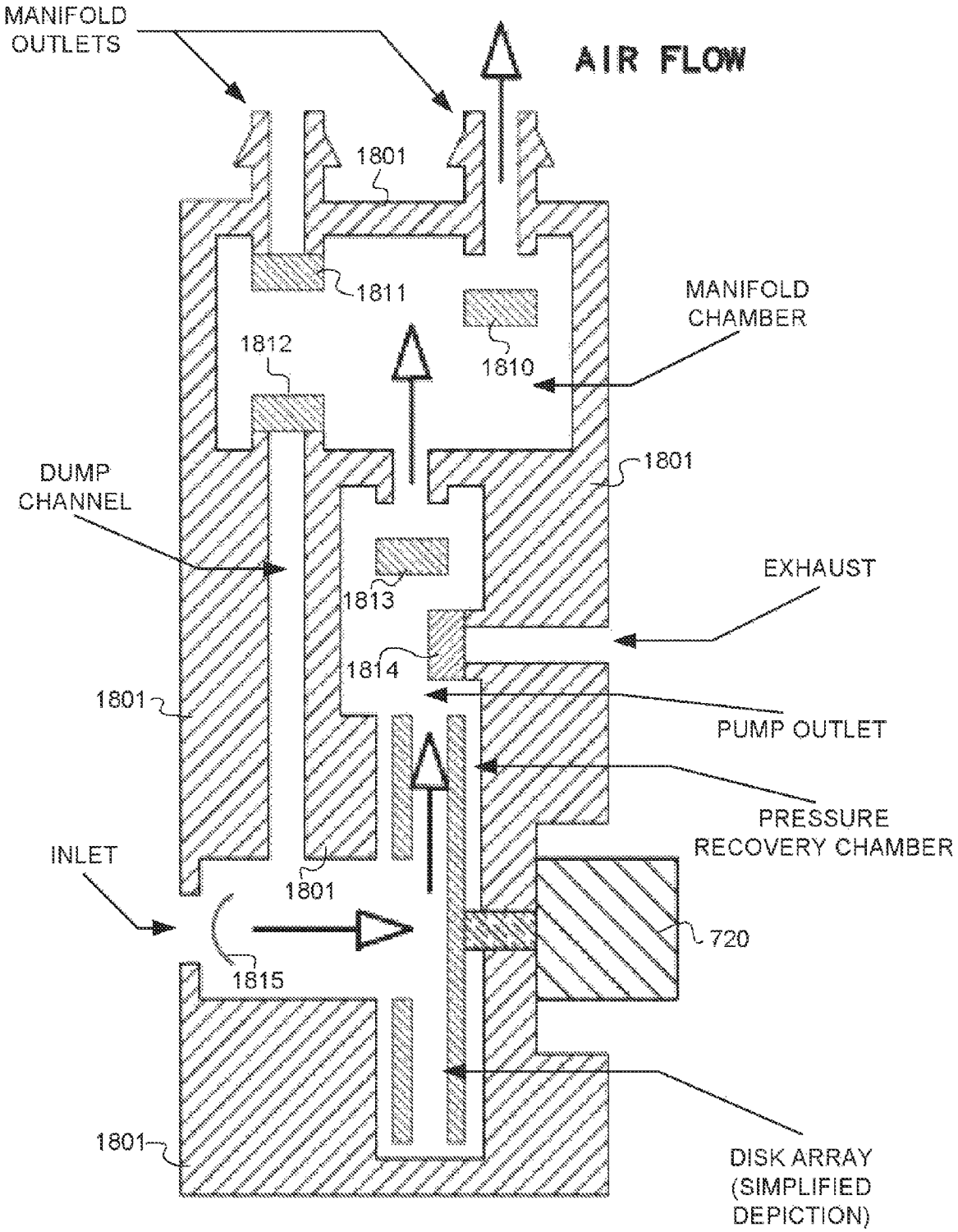
FIG. 18 is a schematic of a cross-sectional view of an integrated pump and manifold capable of powered dumping, with arrows showing the direction of airflow during filling operation.
Figure 19:
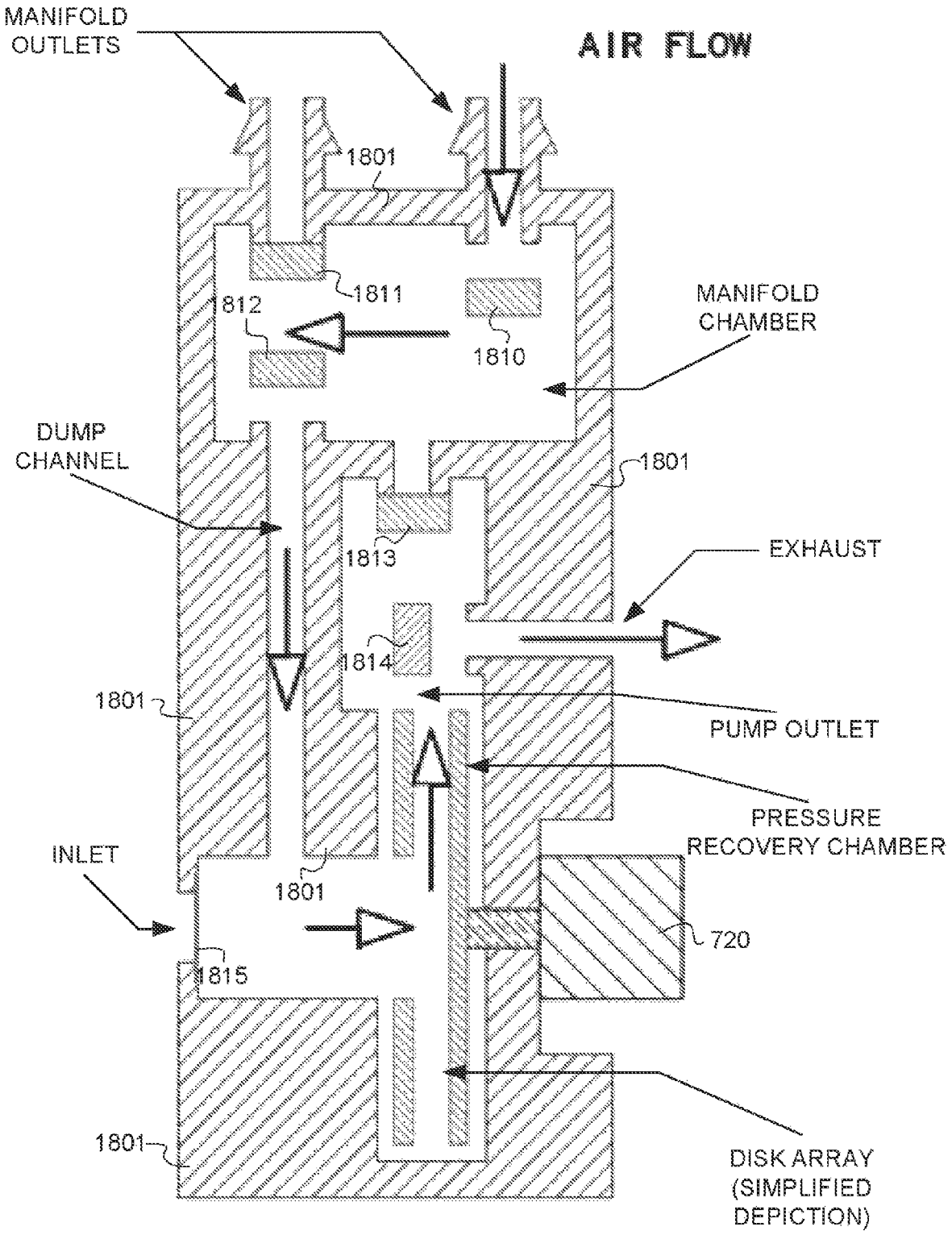
FIG. 19 is a schematic of a cross-sectional view of the integrated pump and manifold capable of powered dumping, with arrows showing the direction of airflow during dumping operation, according to an embodiment of the described principles.

FIGS. 18 and 19 provide a cross-sectional view of an exemplary integrated housing 1800 capable of utilizing the pump to perform a manifold-driven powered dump of one or more air mattress chambers (as opposed to the pump-driven powered dump designs discussed above with respect to FIGS. 14A-16D). FIG. 18 includes arrows showing the flow of gas while the integrated housing 1800 is filling an air mattress chamber, and FIG. 19 includes arrows showing the flow of gas while the integrated housing 1800 is performing a powered dump of the air mattress chamber. Although two manifold outlets are depicted in this exemplary embodiment, it will be appreciated that any number of manifold outlets may be used. The integrated housing body 1801 may be manufactured out of ABS, PP, PC, PPE, or any other suitable material capable of withstanding the pressure and heat generated within the integrated housing body 1801 during operation of the boundary-layer pump.

During the fill operation of the pumping system, depicted by FIG. 18, a flapper valve 1815 is opened at the inlet and a gas (e.g. ambient air) is drawn into a boundary-layer pump. A simplified depiction of the motor 720 and disks (730, 801, 802) is provided, which represents a design similar to that of boundary-layer pump 700 depicted in FIGS. 7A-10, except that the pressure recovery chamber housing cover 710 and body 711 are replaced by the integrated housing 1801. The boundary-layer pump impels the air by the rotation of the disks into the pressure recovery involute and out of the pump outlet. The pressure recovery chamber within the integrated housing 1801 is similarly shaped as the pressure recovery chamber of the boundary-layer pump of FIGS. 7A-10. After the gas travels through the pump outlet, it passes the open solenoid valve 1813 into the manifold chamber, and from the manifold chamber it passes through the opened solenoid valve 1810 to one or more chambers of the air mattress. Solenoid valve 1811, depicted as closed, may also be opened if simultaneous filling of the chambers connected to valves 1810 and 1811 is desired. During fill operation, solenoid valve 1812 connecting the manifold chamber to the dump channel and solenoid valve 1814 connecting the pump outlet to the exhaust remain closed.

During the powered dump operation of the pumping system, depicted by FIG. 19, the flapper valve 1815 at the inlet and the solenoid valve 1813 between the pump outlet and the manifold chamber are closed, and the solenoid valve 1814 at the exhaust and the solenoid valve 1812 at the dump channel are opened. Solenoid valve 1811, depicted as closed, may also be opened if simultaneous powered dumping of the chambers connected to valves 1810 and 1811 is desired. Gas is then drawn from the one or more air mattress chambers connected to solenoid valve 1810 into the manifold, past open solenoid valve 1812, through the dump channel, and into the boundary-layer pump. The boundary-layer pump then impels the air outwards through the pump outlet and past open solenoid valve 1814 into the exhaust channel.

It will be appreciated that although solenoid valves and a flapper valve are depicted in FIGS. 18 and 19, other types of valves may be used. Solenoid valves are preferable at various connection points as they are a cost-effective way of achieving positive electromechanical control, while a flapper valve, which does not provide positive control over the flow, is preferable as a cost-effective way of implementing a valve where positive control over the flow is not required (e.g. at the inlet). Furthermore, it will be appreciated that FIGS. 18 and 19 are merely an exemplary embodiment illustrating the inventive principles, and the integrated housing need not be designed exactly as depicted. One skilled in the art would be able to produce variations of the physical design of the integrated housing based on the teachings herein.

Figure 20:
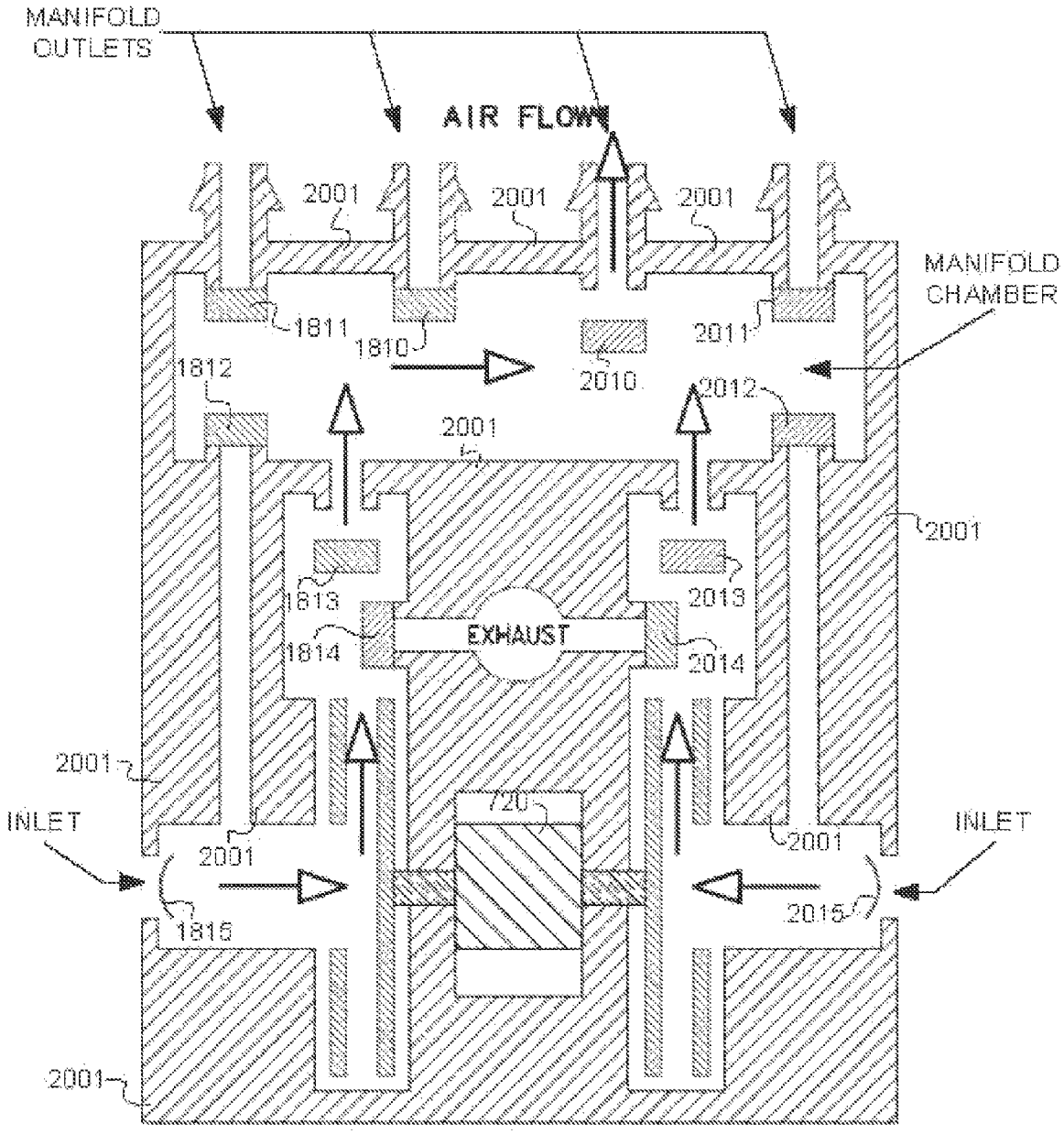
FIG. 20 is a schematic of a cross-sectional view of an integrated pump and manifold with two sets of disks capable of compounding flow and powered dumping, with arrows showing the direction of airflow during filling operation of the pump system.

FIG. 20 provides a cross-sectional view of another exemplary integrated housing 2000, having an integrated housing body 2001, which utilizes two sets of disks on either side of a motor 720 (along with corresponding pressure recovery chambers, pump outlets, inlets, and valves). The integrated housing 2000 is capable of generating a greater amount of flow to one or more air mattress chambers than the exemplary integrated housing 1800 of FIGS. 18 and 19 by compounding the flow from two sets of disks. The integrated housing 2000 is also capable of utilizing the two sets of disks to perform a powered dump of one or more air mattress chambers at a compounded rate of flow. One skilled in the art will appreciate that, instead of utilizing one motor with multiple sets of disks, the integrated housing 2000 can be adjusted to accommodate two independent pumps with separate motors. However, utilizing a single boundary layer pump with one motor and sets of disks connected to either side of the motor is particularly suitable for the integrated housing 2000, allowing a single boundary layer pump to efficiently produce a compounded flow that would have required two independent pumps to produce, while requiring lower cost and occupying less space than two independent pumps.

In FIG. 20, the integrated housing 2000 is depicted during fill operation of one or more chambers of an air mattress connected to the integrated housing 2000 by open solenoid valve 2010. Gas flows into the integrated housing 2000 past flapper valves 1815, 2015 at both inlets and is drawn into the sets of disks on both sides of the motor 720, as indicated by the bolded arrows in FIG. 20. Gas is then impelled through pressure recovery chambers on both sides of motor 720 by the rotation of the sets of disks, out of pump outlets on both sides of motor 720, and into the manifold chamber through open solenoid valves 1813, 2013. In this illustrative embodiment, only solenoid valve 2010 is open, and thus only the chamber (or chambers) of the air mattress connected to the manifold outlet corresponding to solenoid valve 2010 is filled. However, it will be appreciated that any number of the solenoid valves 1810, 1811, 2010, 2011 corresponding to manifold outlets may be opened such that any number of chambers may be simultaneously tilled or dumped.

To perform a powered dumping operation of one or more chambers of an air mattress utilizing the integrated housing 2000, the flapper valves 1815, 2015 at the inlets and solenoid valves 1813, 2013 connecting the pump outlets to the manifold chamber are closed. Solenoid valves 1812, 2012 connecting the manifold chamber to dump channels on both sides of the motor 720 and solenoid valves 1814, 2014 connecting the pump outlets to an exhaust channel are opened. Any number of solenoid valves 1810, 1811, 2010, 2011 may be opened depending on which corresponding chambers are to be dumped. Gas will then flow from the one or more chambers through the manifold chamber, through the dump channels on both sides of the motor 720, and be drawn into the two sets of disks. The gas is then impelled by the rotation of the sets of disks out of the pump outlets on both sides of the motor 720, and out through the exhaust channel.

Figure 21:
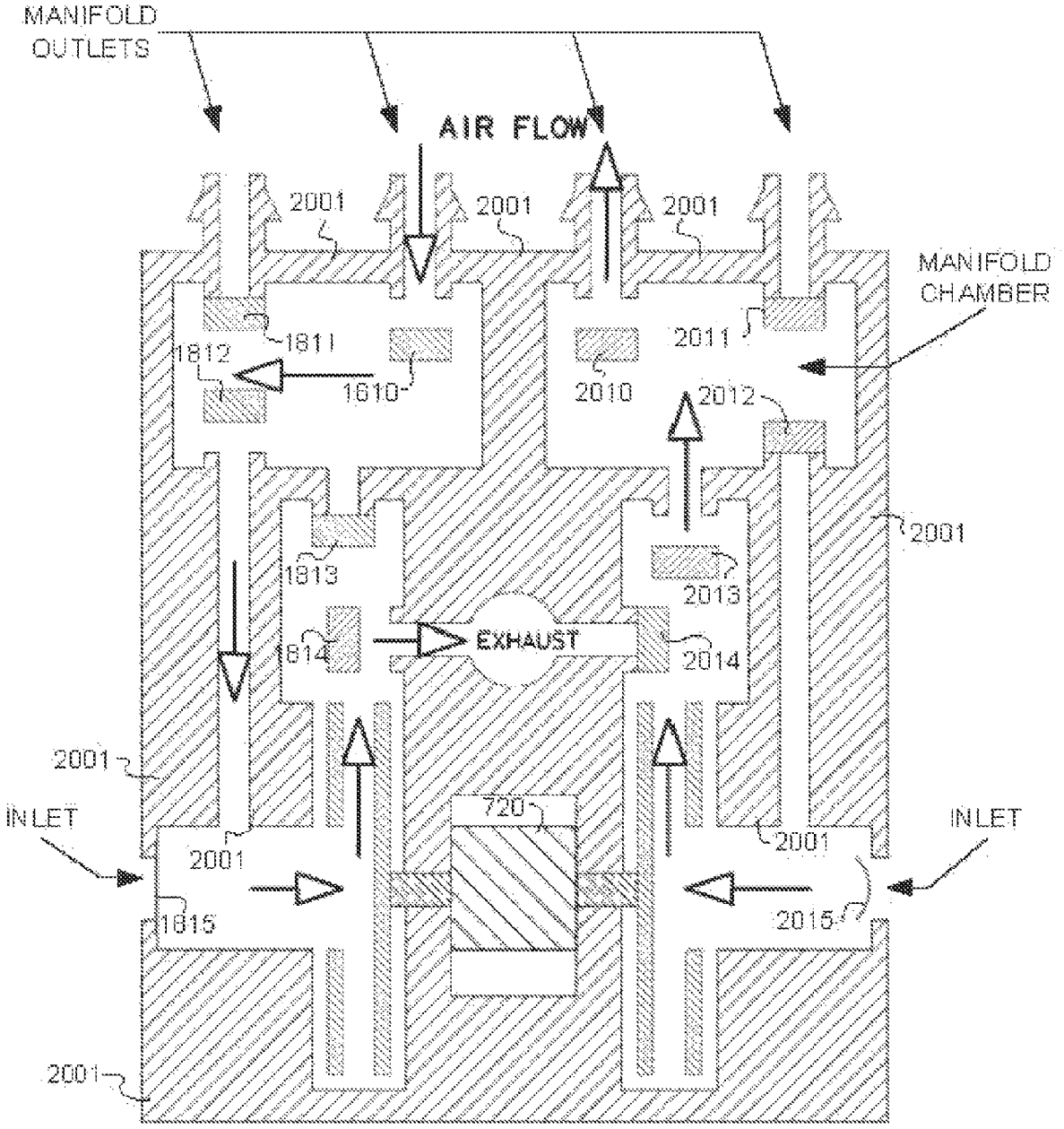
FIG. 21 is a schematic of a cross-sectional view of an integrated pump and manifold with two sets of disks capable of simultaneously filling certain chambers while performing powered dumping of other chambers, with arrows showing the direction of airflow.

FIG. 21 provides a cross-sectional view of yet another exemplary integrated housing 2100, similar to the integrated housing 2000 of FIG. 20, except that the manifold chamber of integrated housing 2000 is divided into two separate manifold chambers in integrated housing 2100. Separating the manifold chamber into two manifold chambers allows each set of disks to service different manifold outlets separately, making it possible to perform a fill operation with one set of disks for one or more chambers while simultaneously performing a dump operation with the other set of disks for one or more other chambers. FIG. 21 depicts the left side of integrated housing 2100 performing a powered dump operation with respect to the one or more chambers connected to the manifold outlet corresponding to open solenoid valve 1810, while at the same time performing a fill operation with respect to the one or more chambers connected to the manifold outlet corresponding to open solenoid valve 2010. The flow of gas is depicted by the arrows in FIG. 21, traveling a similar path on the filling side and the dumping side as described with respect to FIGS. 18 and 19, respectively.

It will be appreciated that, as with other embodiments of the described invention, the solenoid valves are capable of positive control over the flow in connection with control unit 114, and therefore, although the motor 720 rotates both sets of disks at the same amount of RPMs, the amount of gas being pumped into the manifold chambers on either side of the integrated housing 2100 may be simultaneously and independently controlled. Thus, the integrated housing 2100 is further capable of simultaneously dumping different amounts of gas from both sides of the integrated housing 2100, filling both sides of the integrated housing 1100 to different amounts of pressure, or dumping a certain amount from one side while filling the other side with a different amount. It will further be appreciated that, as with other embodiments of the described invention, "one-way" solenoid valves solenoid valves that only make a seal in the relaxed state) are preferable due to their effectiveness in positive flow control applications and relatively low cost. It will further be appreciated that, while the amount of gas allowed into a chamber may be controlled through the solenoid valves, the flow rate is determined by the RPMs of the disk arrays, the physical geometry of the disk arrays and the chambers surrounding the disk arrays, and the back pressure at the outlets corresponding to the disk arrays.

In a further embodiment, the separate manifold chambers may be connected, and the connection may include a valve, such that the pump is capable of tilling or dumping with compounded flow with respect to any of the manifold outlets (when the valve is open), as well as being capable of independently and simultaneously filling and dumping with respect to separate manifold outlets (when the valve is closed). This is described in further detail below with respect to FIG. 24.

Figure 22:
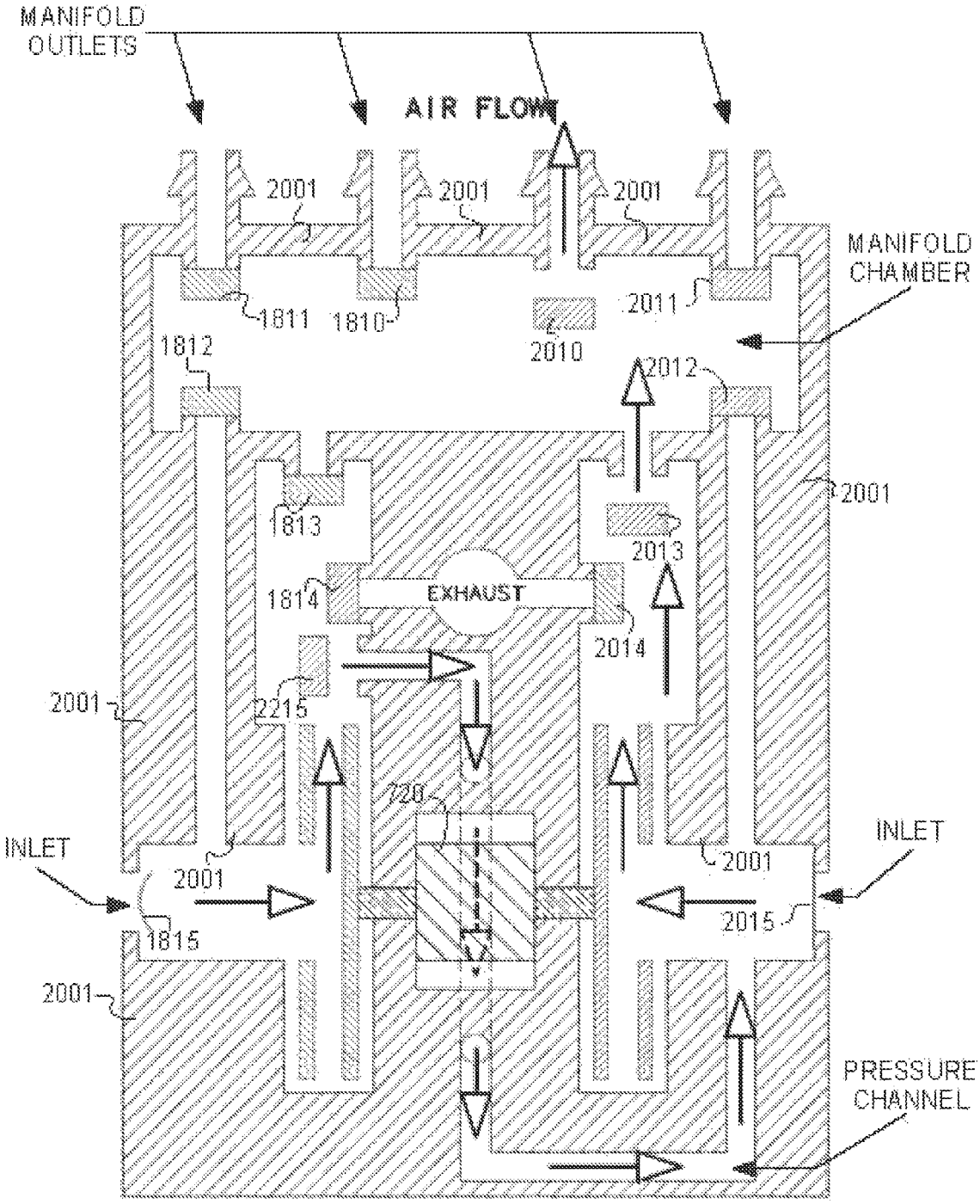
FIG. 22 is a schematic of a cross-sectional view of an integrated pump and manifold with two sets of disks capable of compounding pressure or flow and capable of powered dumping, with arrows showing the direction of airflow during filling operation of the pump system with compounded pressure.

FIG. 22 provides a cross-sectional view of yet another exemplary integrated housing 2200, similar to the integrated housing 2000 of FIG. 20, and capable of performing compounded flow (with solenoid valve 2215 closed) as described above with respect to FIG. 20. The integrated housing 2200 further comprises a pressure channel that connects a pump outlet corresponding to one set of disks to a pump inlet corresponding to the other set of disks. The pressure channel is depicted as passing under the motor 720 in FIG. 22, but it will be appreciated that the design and position of the pressure channel may be varied or modified, so long as the pressure channel allows gas to travel from the pump outlet corresponding to one set of disks into the disk inlets of the other set of disks.

When the pressure channel valve 2215 is open and other valves 1813, 1814 at the first pump outlet are closed, gas that enters the integrated housing at the inlet corresponding to open flapper valve 1815 is impelled by rotation of the disks (on the left side of the motor 720) through the pressure channel and further impelled by rotation of the disks (on the right side of the motor 720) into the manifold chamber and out through the manifold outlets. This design allows for compounding of pressure (as opposed to the compounding of flow when valve 2215 is closed and the two sets of disks are operated in parallel), as the rotation of the first set of disks raises the pressure of the gas within the pressure channel, and thus gas is entering the second set of disks at a higher initial pressure than if it had entered the second set of disks from the atmosphere through the inlet 2015 (e.g. during a compounded flow operation). The rotation of the second set of disks allows a relatively higher pressure (up to more than double the amount of pressure relative to a boundary-layer pump with only one set of disks) in the manifold chamber and in any air mattress chamber connected to the manifold chamber by an open valve (e.g. solenoid valve 2010 as depicted).

Figure 30:
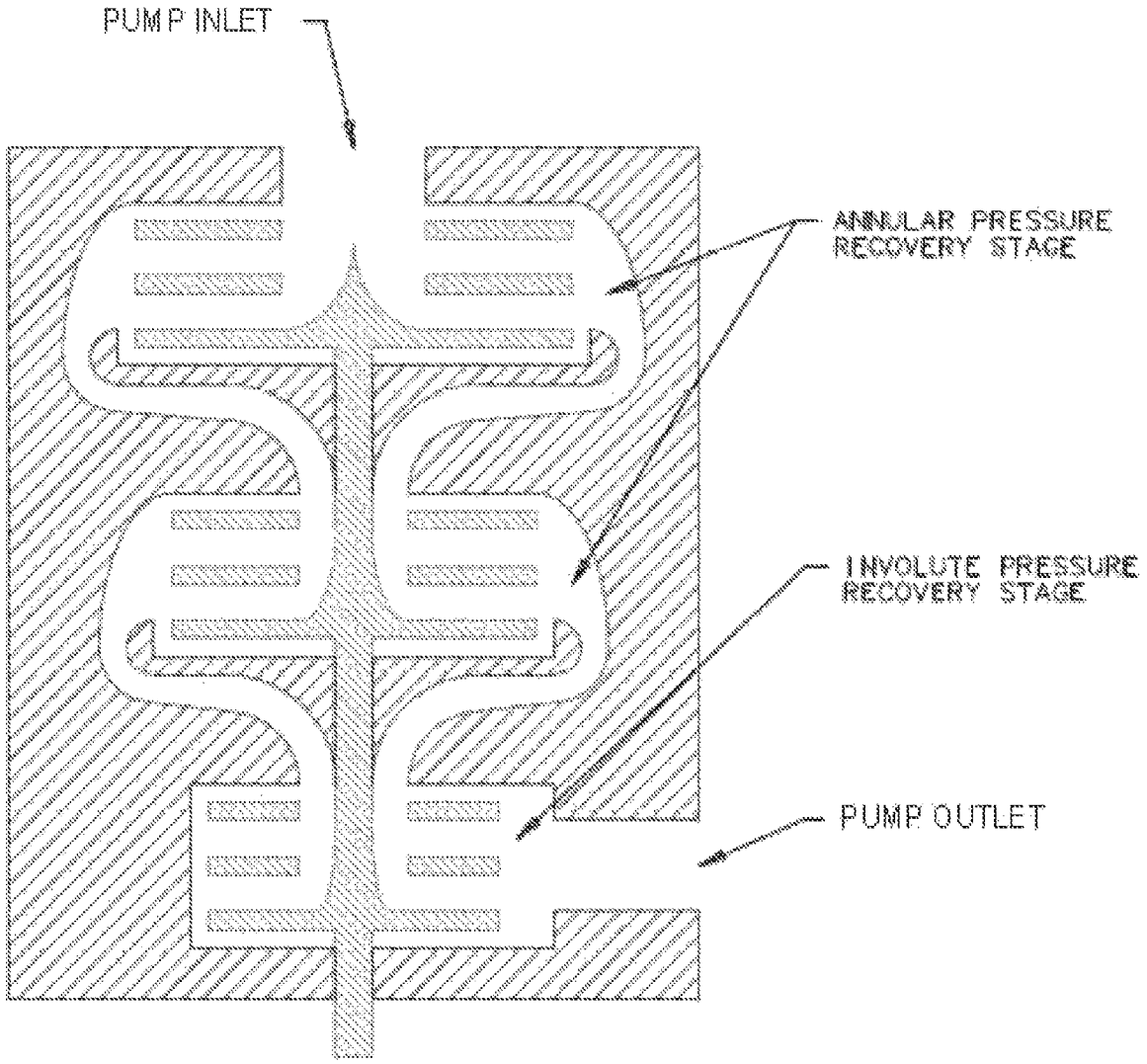
FIG. 30 is a schematic of a cross-sectional view of three pressure recovery stages of a multi-stage disk array configuration, including two annular pressure recovery stages.

As mentioned above, in alternative implementations, the chamber surrounding the first set of disks may be designed with an annular shape rather than an involute shape. It will be appreciated that, while a pressure recovery involute has many advantages including packaging and manufacturing simplicity, other types of expansion plenums may be advantageous for compounding pressure. For example, if the chamber around the first set of disks has an annular design, it may be more efficient in pumping an air mattress chamber on its own or in compounding flow. However, the annular design, which is particularly suited to deliver pressurized flow to a desired location in a compounding pressure implementation, may be more difficult to manufacture and may be more costly as a result. An example of one implementation of a boundary-layer pump including multiple annular pressure recovery stage is discussed in further detail below with reference to FIGS. 30 and 31.

FIG. 23 provides a cross-sectional view of yet another exemplary integrated housing 2300, similar to the integrated housing 2200 of FIG. 22 and also capable of compounding flow and compounding pressure as described above with respect to FIG. 22, FIG. 23, however, instead of having a similarly-sized sets of disks on both sides of the motor, has differently-sized sets of disks on either side of the motor. This allows greater control for achieving specific pressure values, as well as increasing the efficiency of the pump during the compounding flow operation (regardless of whether the pump is filling or dumping). Given Bernoulli's principle and the insensitivity to pressure changes, the geometry, number and spacing of disks in a disk array at a given RPM may be tailored and matched to provide an optimally efficient design for generating or compounding pressure, balancing the flow area through the sets of disks with the expected amount of compression of gas, as described below. The arrows depicted in FIG. 23 illustrate the path traveled by gas during filling operation with compounded pressure.

Using the iterative calculation method described above based on Bernoulli's principle, an optimal disk inlet area of the second set of disks and the corresponding pressure recovery chamber may be determined by using the $p_2$ used for the calculation pertaining to the first set of disks as the $p_1$ for the calculation pertaining to the second set of disks. Generally, this will result in smaller A1 and A2 values with respect to the second set of disks. However, while A1 and A2 may be smaller, it will be appreciated the p2/p1 ratio may be affected by disk size, RPMs, disk inlet design and number of disks, so in certain implementations, the actual size of the second set of disks need not be smaller than the first set of the disks, depending on the RPMs and number of disks used.

Figure 23:
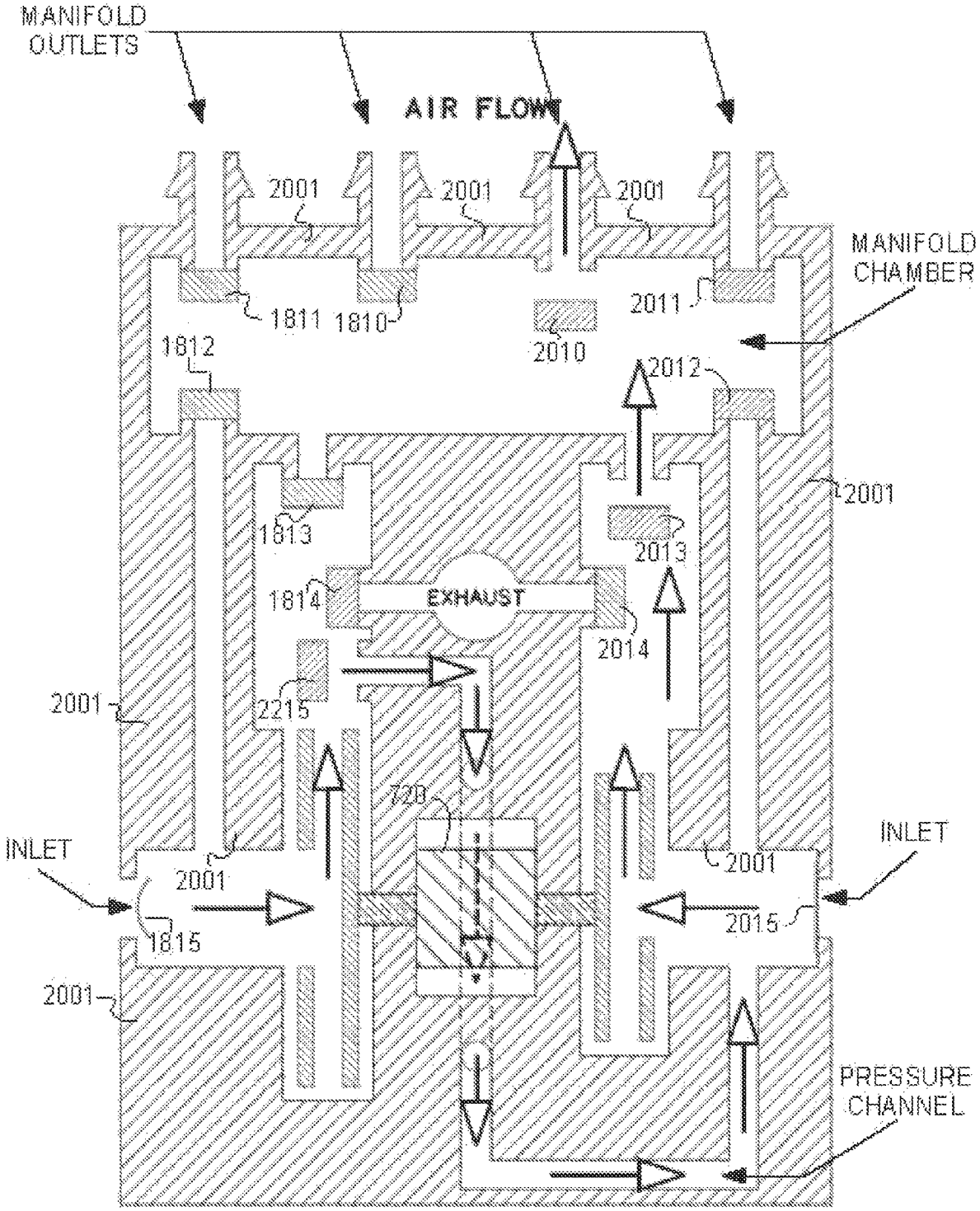
FIG. 23 is a schematic of a cross-sectional view of an integrated pump and manifold with two dissimilarly sized sets of disks that are matched for pressure compounding, capable of pressure or flow compounding and capable of powered dumping, with arrows showing the direction of airflow during filling operation of the pump system with finely tuned compounded pressure.

Fine-tuning of the pressure may be achieved in the one or more air mattress chambers connected to the manifold outlet at solenoid valve 2010 with an appropriate control algorithm, as a control routine with a set feedback rate will intrinsically provide a "finer" level of control with a smaller array of disks (as depicted to the right of the motor 720 in FIG. 23). A simple control loop carried out by a micro-controller within the control unit may include: initiating a pressure measurement, averaging a number of readings obtained through analog to digital converter hardware, determining whether the averaged value is below or above the target, and continuing or stopping the process based on the determination. The control loop takes time to carry out these steps (somewhere in the neighborhood of 100 ms to 500 ms), and the boundary-layer pump may be filling or dumping while the control loop is taking measurements. Thus, when the measured pressure approaches the target pressure, it may be advantageous to switch from using a larger disk array or both disk arrays to only using the smaller disk array in order to allow for "finer" control.

In an illustrative example, if the desired pressure is relatively low, both sets of disks may be used to quickly fill a chamber to a pressure that is close to the desired pressure through compounded flow (i.e. with valves 1815, 2015, 1813, 2013 and 2010 open while leaving all other valves closed), and after a certain point when the pressure in the chamber approaches the desired pressure, only the second, smaller set of disks is used to achieve the desired pressure (e.g. by closing valves 1812, 1813, 1814 and 2215, which isolates the first set of disks from the manifold chamber; or by closing valves 1812, 1813 and 2215 and opening valve 1814 and having the first set of disks simply impel air from the inlet to the exhaust). Similarly, in another illustrative example, if the desired pressure is relatively high, both sets of disks may be used in compounded flow mode until the pressure reaches a certain point, and then the appropriate valves could be closed/opened to change the operation of the two sets of disks to compounded pressure mode until the desired pressure is achieved. It will further be appreciated that the described principles may be applied to the powered dumping operation as well. For example, if the desired pressure of the chamber is relatively low, both sets of disks may be used to dump with compounded flow down to a certain pressure that approaches the desired pressure. Then, after that point, only the smaller set of disks is used to dump the gas down to the desired pressure. Alternatively, when the dumping operation approaches the desired pressure, the motor could simply be shut off and the air mattress chamber may be allowed to passively deflate down to the desired pressure.

Figure 24:
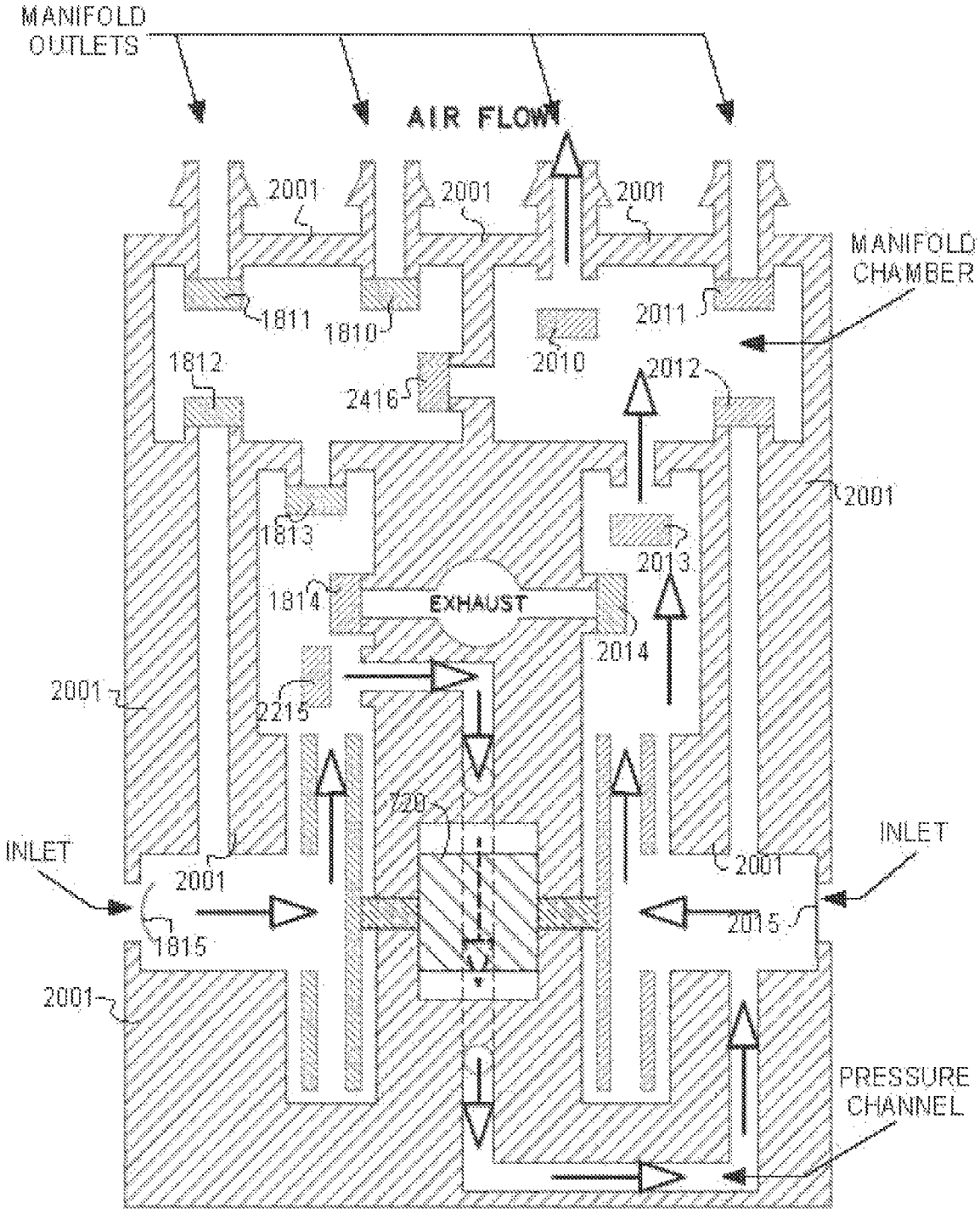
FIG. 24 is a schematic of a cross-sectional view of an integrated pump and manifold with two sets of disks capable of compounding pressure or flow and capable of powered dumping, further capable of simultaneously filling certain chambers while performing powered dumping of other chambers, with arrows showing the direction of airflow during filling operation of the pump system with compounded pressure.

FIG. 24 provides a cross-sectional view of yet another exemplary integrated housing 2400, similar to the integrated housing 2200 of FIG. 22 and also capable of compounding flow and compounding pressure as described above with respect to FIG. 22. The integrated housing 2400 further has a manifold chamber divided into two separate chambers by a solenoid valve 2416. Inclusion of two separate chambers within the manifold chambers connected by a valve allows a single pump to provide a large variety of filling and dumping options to the air mattress chambers connected to the manifold outlets.

With respect to fill operations, the pump may perform filling with respect to any of the manifold outlets or combination of manifold outlets with compounded flow (with appropriate valves 1815, 2015, 1813, 2013, 2416 open) or with compounded pressure (with appropriate valves 1815, 2215, 2013, 2416 open). The pump may also perform filling operations with respect to two or more manifold outlets independently with valve 2416 closed. Similarly, the pump may perform dumping with respect to any of the manifold outlets or combination of manifold outlets with compounded flow or compounded pressure with appropriate valves open, and the pump may also perform dumping operations with respect to two or more manifold outlets independently with valve 2416 closed.

Figure 25:
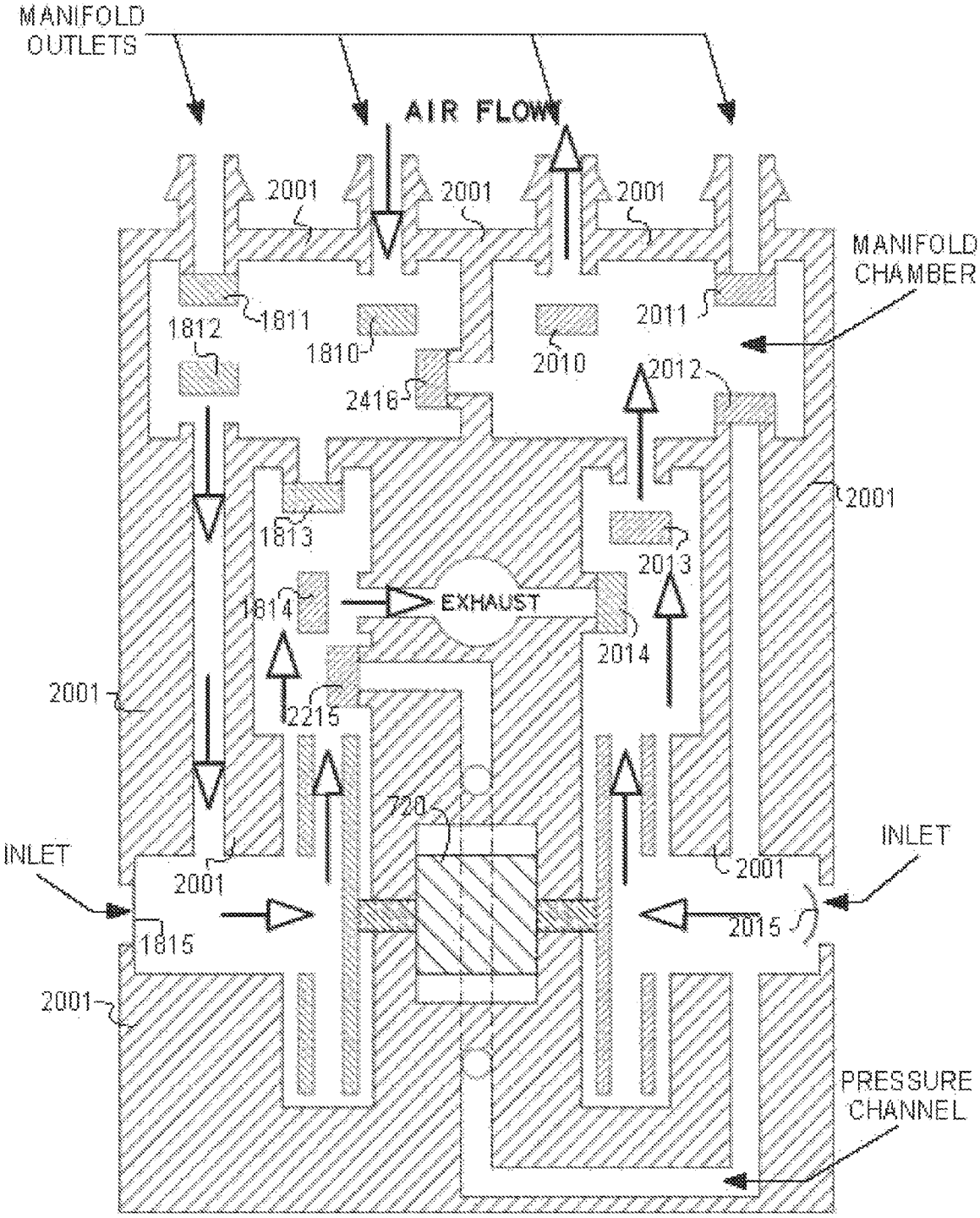
FIG. 25 is a schematic of a cross-sectional view of the integrated pump and manifold of FIG. 24, with arrows showing the direction of airflow during simultaneous dumping of the left side and filling of the right side.

Additionally, as depicted in FIG. 25, the pump with integrated housing 2400 may simultaneously perform dumping with respect to manifold outlets connected to one chamber of the manifold chamber white performing filling with respect to manifold outlets connected to the other chamber of the manifold chamber when solenoid valve 2416 is closed. On the left side of FIG. 25, gas from one or more air mattress chambers corresponding to the manifold outlet at solenoid valve 1810 flows through the dump channel on the left, into the left set of disks, and is impelled out the exhaust through open solenoid valve 1814. Meanwhile, on the right side of FIG. 25, gas is impelled by the right set of disks 2030 from the right inlet into a manifold chamber through solenoid valve 2013, and further into one or more air mattress chambers corresponding to the manifold outlet at solenoid valve 2010.

Figure 26:
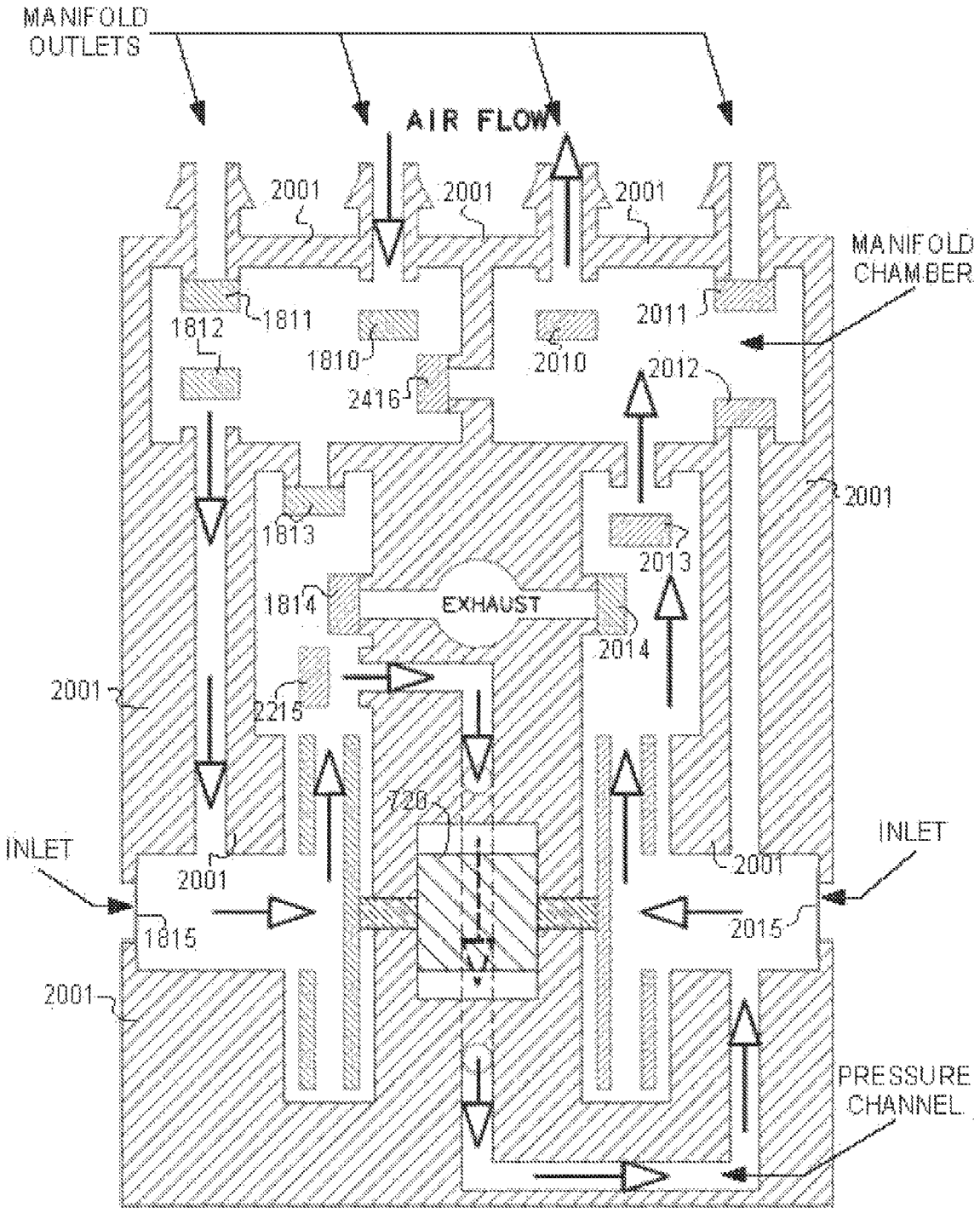
FIG. 26 is a schematic of a cross-sectional view of the integrated pump and manifold of FIG. 24, with arrows showing the direction of airflow during simultaneous dumping of the left side and filling of the right side, wherein the gas being dumped from one side is used to fill the other side.

Furthermore, in FIG. 26, the pump with integrated housing 2400 is depicted during a simultaneous dump and fill operation where gas from one or more chambers corresponding to one manifold outlet is pumped directly into one or more chambers corresponding to another manifold outlet. This type of simultaneous dump and fill from one outlet to another may be particularly useful in certain medical applications, such as, for example, where paired dump and fill operations may be used to roll patients in bed. Gas from one or more air mattress chambers corresponding to the manifold outlet at solenoid valve 1810 flows through the dump channel on the left and is impelled through the left set of disks into the pressure channel through open solenoid valve 2215. The gas is then further impelled through the right set of disks 2030 into the manifold chamber through open solenoid valve 2013, and further into one or more air mattress chambers corresponding to the manifold outlet at solenoid valve 2010. In effect, this is similar to a compounded pressure fill operation of the one or more air mattress chambers corresponding to the manifold outlet at solenoid valve 2010, except that the gas is drawn from another air mattress chamber through the left dump channel instead of through the left housing inlet at flapper valve 1815.

For clarity of depiction, only one pressure channel is depicted in FIGS. 24-26. However, it will be appreciated that the integrated housing 2400 may include another pressure channel connecting the outlet of the second set of disks (depicted on the right) to the inlet of the first set of disks (depicted on the left), such that there are two separate pressure channels and simultaneous dumping and filling from one manifold outlet to another manifold outlet may be performed in either direction, depending on which valves are open and closed.

In further embodiments, the integrated housing may be designed with one motor attached to more than two sets of disks, or the integrated housing may further include a second motor and additional sets of disks connected to the second motor. While implementing these designs with more than two sets of disks is possible given the teachings herein, the air mattress industry would not typically require pressures greater than approximately 1.0 psi, which is readily achievable with boundary-layer pump designs utilizing one or two sets of disks. However, in certain medical applications or other special circumstances, it is conceivable that pressures higher than what may be readily attainable by pump designs utilizing one or two sets of disks may be useful. In such cases, it will be appreciated that the principles described herein may be extended to boundary-layer pump designs utilizing more than two sets of disks. For example, a more powerful motor may be used in connection with more than two disk arrays with appropriate adjustments to the integrated housing. In another example, separate integrated housings may be modified to allow connection to one another to utilize multiple motors and a plurality of disk arrays.

It will be appreciated that the integrated housing designs depicted in FIGS. 22-24 using two sets of disks are well-suited for abroad performance spectrum, allowing a large range of pressures and flows to be produced from a single device depending on the application. Simply by opening and closing the appropriate valves through the control unit, the pump can fill or dump, one or more chambers of an air mattress, independently or simultaneously, at a flow rate within a broad range of flow rates, to pressures within a broad range of pressures. In certain embodiments, different chambers may be filled and dumped independently, and simultaneously, and in further embodiments, differently-sized disks further allow for higher pressure compounding efficiency or fine-tuning of the filling and dumping operations.

While the boundary-layer pump is particularly suited for the exemplary embodiments of integrated housings depicted in FIGS. 18-24 due to its ability to generate relatively large amounts of flow as well as relatively large amounts of pressure, it will also be appreciated that the depicted integrated housings can be modified to accommodate other types of pumps, such as replacing the boundary layer pump two sets of disk arrays with multiple squirrel cage blowers or diaphragm pumps, making appropriate modifications to the housing as necessary. However, due to the efficiency advantages, cost advantages, and relative simplicity of design of using a boundary-layer pump, utilizing other types of pumps with the depicted integrated housings is not preferable.

It further be appreciated that, for certain exemplary pump products, the boundary layer pumps depicted in the various embodiments of FIGS. 18-24 may be housed separately from the manifold chambers in a more distributed pump housing rather than the integrated housing depicted in FIGS. 18-24. In exemplary embodiments having separate housings for the pump and the manifold chamber, appropriate connections between the housings are made. For example, pump outlets may be connected to a separately housed manifold chamber through appropriate tubes and valves, and the manifold chamber could include additional ports to connect the manifold to the pump inlets (the connection being the dump channel for powered dumping applications). However, having an integrated housing may often be preferable due to efficiency, cost, and design advantages relative to a distributed housing.

It will also further be appreciated that the various embodiments depicted in FIGS. 18-26 allow manifold-driven powered dumping using a motor rotating in one direction. Although a reversible motor could be used in the embodiments depicted in FIGS. 18-26, the dump channel allows the rotation of the set or sets of disk in just one direction to achieve filling operation and/or powered dumping based on which valves are open or closed (as discussed above in detail).

Figure 27:
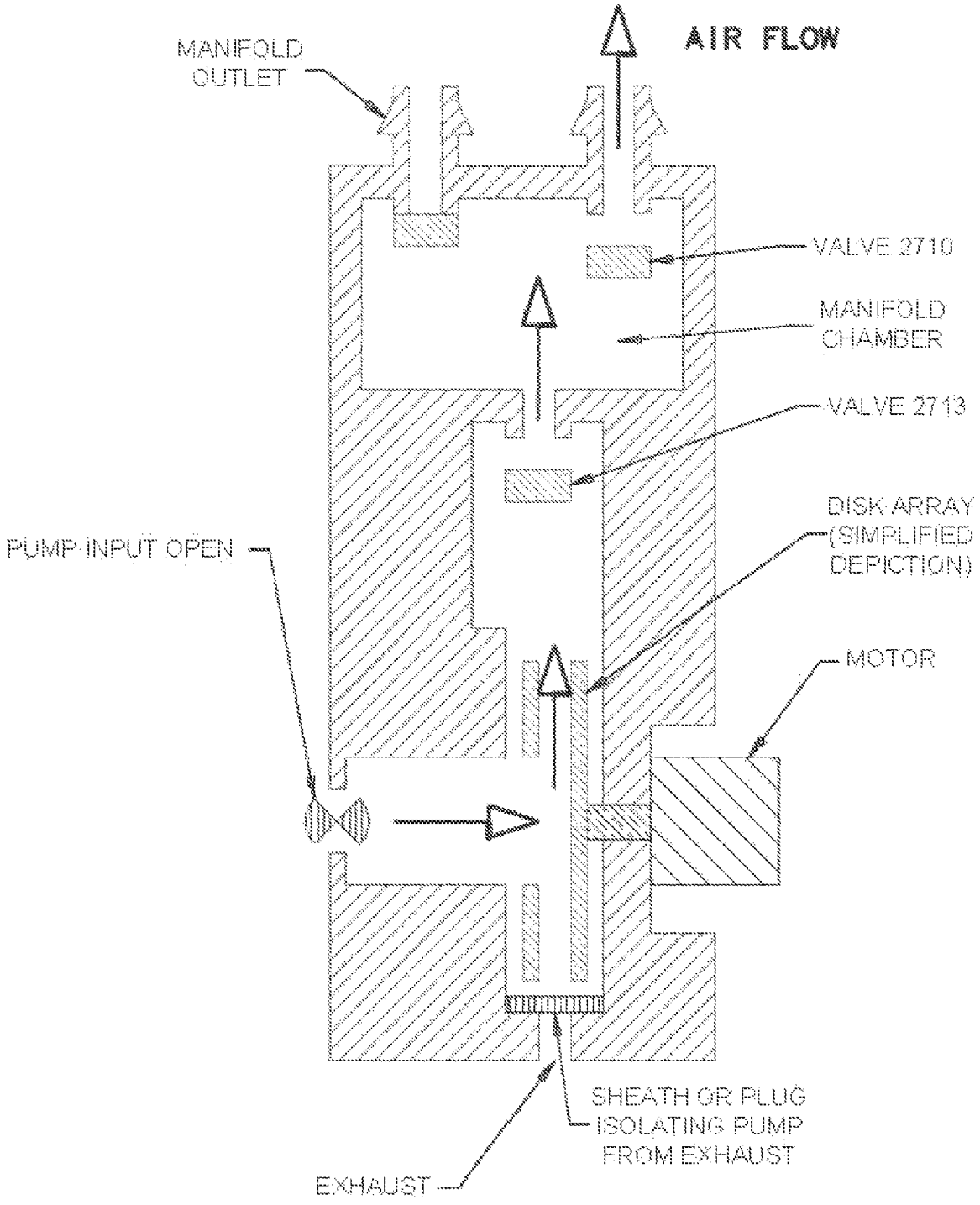
FIG. 27 is a schematic of a cross-sectional view of an integrated pump and manifold capable of powered dumping, with arrows showing the direction of airflow during filling operation.
Figure 28:
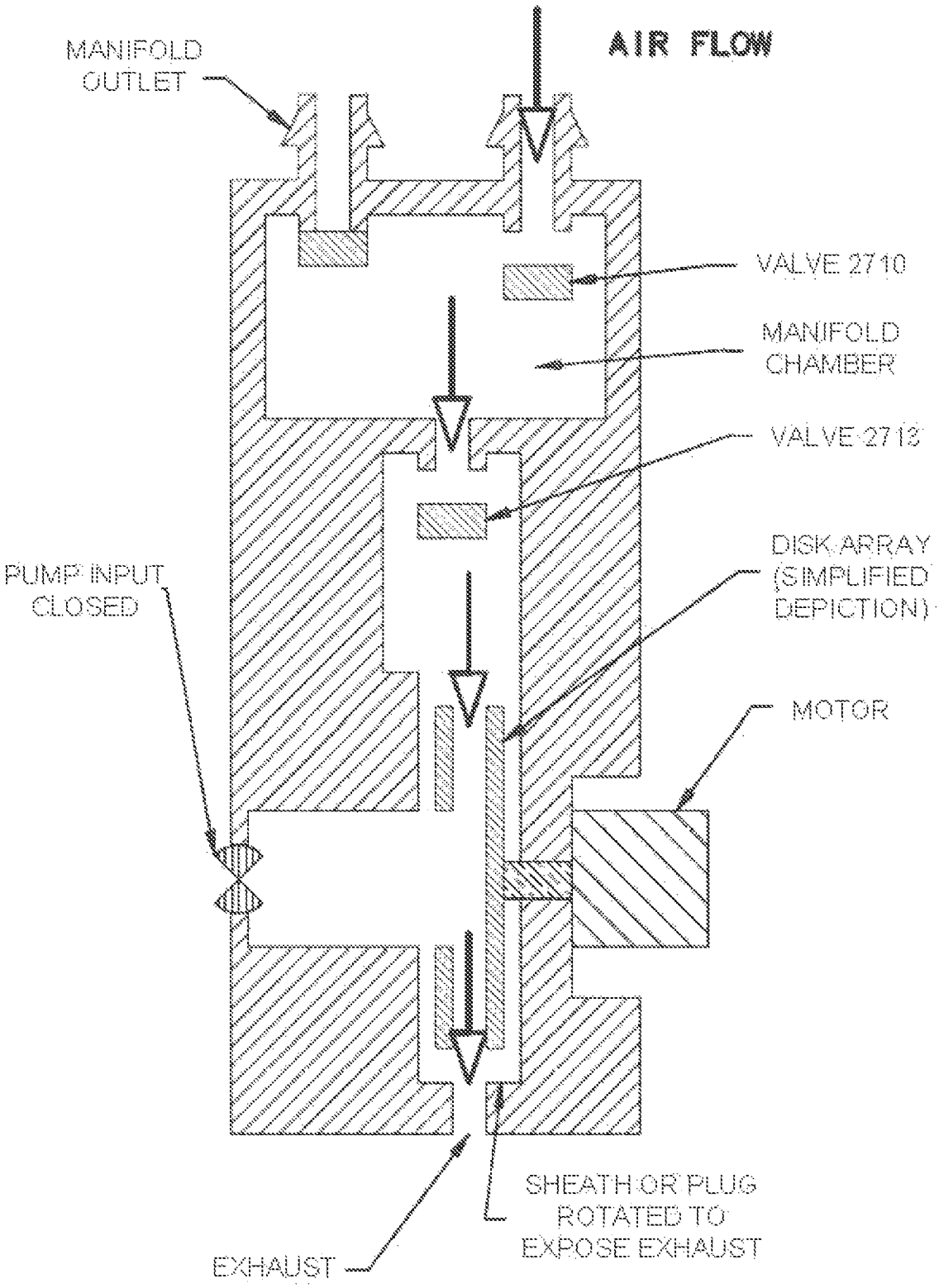
FIG. 28 is a schematic of a cross-sectional view of the integrated pump and manifold depicted in FIG. 27, with arrows showing the direction of airflow during powered dumping operation.

The configurations of pump housings utilizing manifold-driven powered dumping are more complex and more expensive than pump housings utilizing pump-driven powered dumping, requiring more valves and additional manufacturing considerations. However, these manifold-driven configurations significantly outperform the pump-driven configurations in powered dumping trials. Thus, as mentioned above, there is a tradeoff between performance and complexity (and cost). The pump housing configurations utilizing manifold-driven powered dumping have the best performance, but require greater cost and complexity relative to the pump housing configurations using For comparison, FIGS. 27 and 28 depict an integrated housing 2700 that utilizes pump-driven powered dumping. This exemplary integrated housing 2700 allow for a smaller pump housing having fewer components, but also does not achieve as much negative pressure during powered dumping as pump housing configurations utilizing manifold-driven powered dumping.

FIG. 27 is a schematic diagram showing air flow through an integrated housing 2700 during filling operation. The pump in FIG. 27 may be any of the pumps capable of powered dumping discussed above with respect to FIGS. 14A-16D (or a pump having another similar design). During filling operation, the pump inlet is open (i.e., exposing the pressure recovery chamber to atmosphere via the pump inlet), as represented in FIG. 27 by an open valve, and air passes through the pump inlet to the disks and is impelled into the manifold chamber past open valve 2713 and out of the manifold past open valve 2710. During filling operation, a sheath or plug isolates the pressure recovery chamber from the exhaust (as shown in FIG. 27). During powered dumping operation, as depicted in FIG. 28, the pump inlet would be closed (i.e., not exposing the pressure recovery chamber to atmosphere via the pump inlet), and the sheath or plug would be positioned so as to expose the pressure recovery chamber to the exhaust.

In a further embodiment designed for an extremely cost sensitive application, valve 2713 could be omitted from the pump configuration shown in FIGS. 27-28 at the expense of not having a redundantly sealed air chamber.

Based on the disclosures provided herein, it can be seen that there are a wide variety of pump housing configurations that can be tailored to fit particular performance and cost requirements. An example of a relatively low-cost configuration that is still able to achieve the relatively advanced function of powered dumping from one air mattress chamber to another air mattress chamber is presented in FIG. 29.

Figure 29:
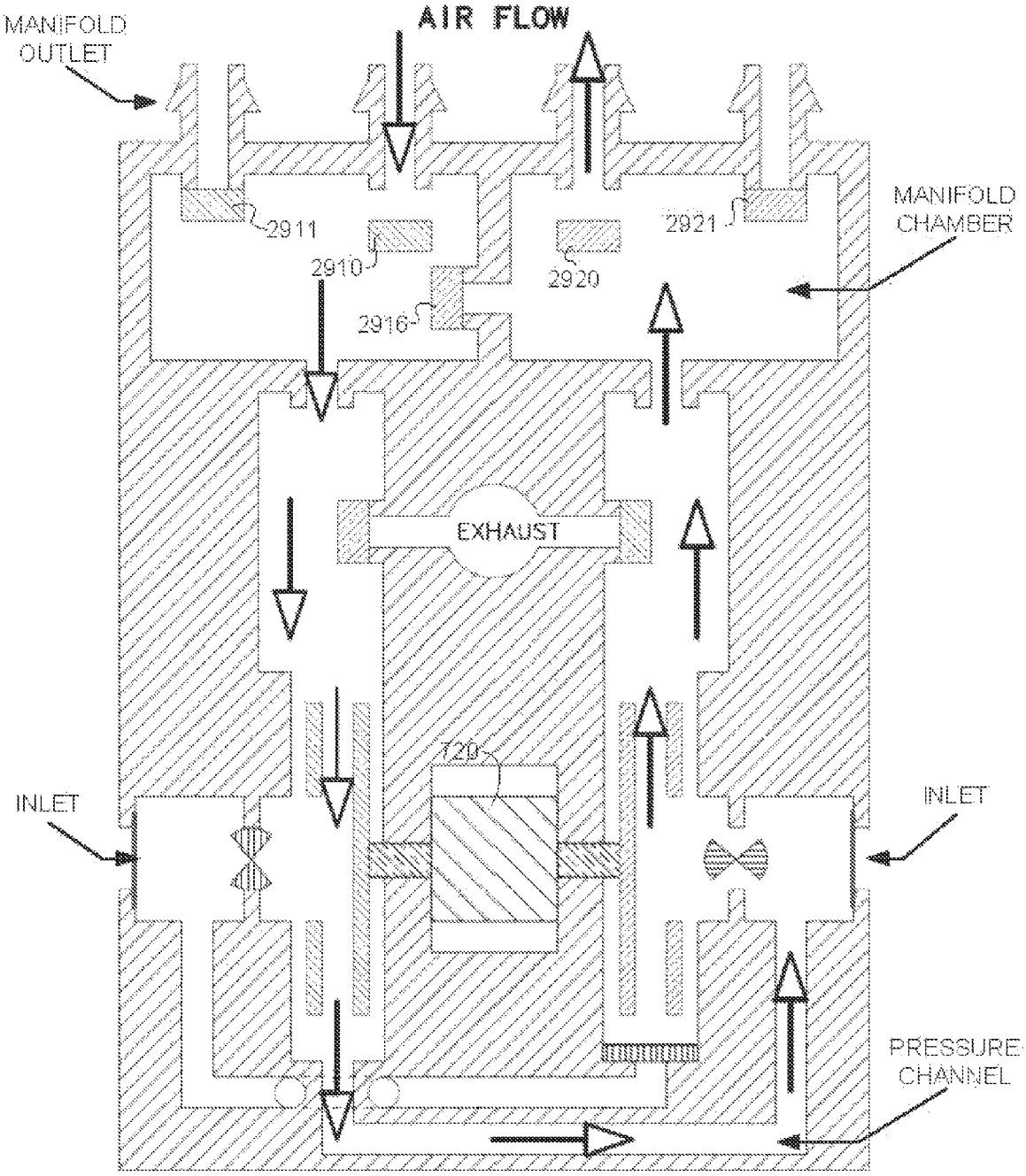
FIG. 29 is a schematic of a cross-sectional view of an integrated pump and manifold with two sets of disks capable of compounding flow and capable of powered dumping, with arrows showing the direction of airflow during simultaneous dumping of the left side and filling of the right side, wherein the gas being dumped from one side is used to fill the other side.

FIG. 29 depicts an integrated housing 2900 that utilizes the relatively tow-cost pump-driven powered dumping design utilizing a non-reversible motor discussed above with respect to FIGS. 16A-16D together with the double-sided disk array integrated housing configurations depicted in FIGS. 20-26. The integrated housing 2900 includes a manifold chamber with manifold outlets corresponding to solenoid valves 2910, 2911, 2920, 2921, and a valve 2916 for isolating one part of the manifold chamber from another. The arrows shown in FIG. 29 correspond to air being dumped from one chamber corresponding to manifold valve 2910 and pumped into another chamber corresponding to manifold valve 2920 via the rotation of both sets of disks attached to the motor 720. The pump corresponding to the disk array on the left side of FIG. 29 has its pump inlet in a closed position and its pump exhaust connected to the pressure channel in an open position, while the pump corresponding to the disk array on the right side of FIG. 29 has its pump inlet in an open position and its pump exhaust connected to the pressure channel in a closed position (i.e., blocked by a plug or sheath). Both sides have the housing inlets in a closed position and pump exhausts connected to atmosphere in a closed position.

It will be appreciated that, with different valves opened and closed, the integrated housing 2900 allows for a variety of other filling and powered dumping operations as well, including, for example, filling one or more chambers with compounded flow, filling a chamber while simultaneously dumping another chamber (where the filling is performed with external air and the dumped air leaves the pump through the an exhaust connected to atmosphere), and compounded dumping of one or more chambers. Furthermore, it will be appreciated that the integrated housing 2900 achieves this variety of capabilities while requiring relatively less solenoid valves and a simpler manifold design than is required by the integrated housings having double-sided disk array configurations utilizing a dump channel as shown in FIGS. 20-26 above.

While the embodiments of boundary-layer pumps referred to above have generally been discussed in the context of having an involute shape for the pressure recovery chamber, it will be appreciated that other designs of the expansion plenum (i.e., the pressure recovery chamber) may be used depending on the context. For example, an annular design for the expansion plenum may be preferable in applications where compounding pressure is particularly important. In a further embodiment, the inlet and outlet of an annular expansion plenum are positioned in line with each other each other.

In yet another further embodiment, both annular and involute-shaped pressure recovery chambers can be used together in multiple stages, for example, in applications requiring a large amount of pressure. An example of a three-stage configuration 3000 showing simplified depictions of the disk arrays and the shapes of the multiple pressure recovery chambers is provided by FIG. 30. Gas flows into the first annular pressure recovery stage (at the top of FIG. 30) through a pump inlet, and rotation of the disks in the first annular pressure recovery stage causes the gas to be impelled radially outwards to the walls of the first stage. The gas passes through a second annular pressure recovery stage and finally an involute-shaped pressure recovery stage, which impels the gas out through a pump outlet. Because of the shape of the annular pressure recovery stages shown in FIG. 30, the flow fields within the disk stacks created by the annular pressure recovery stages are relatively more uniform and more efficient relative to involute-shaped pressure recovery stages.

Figure 31:
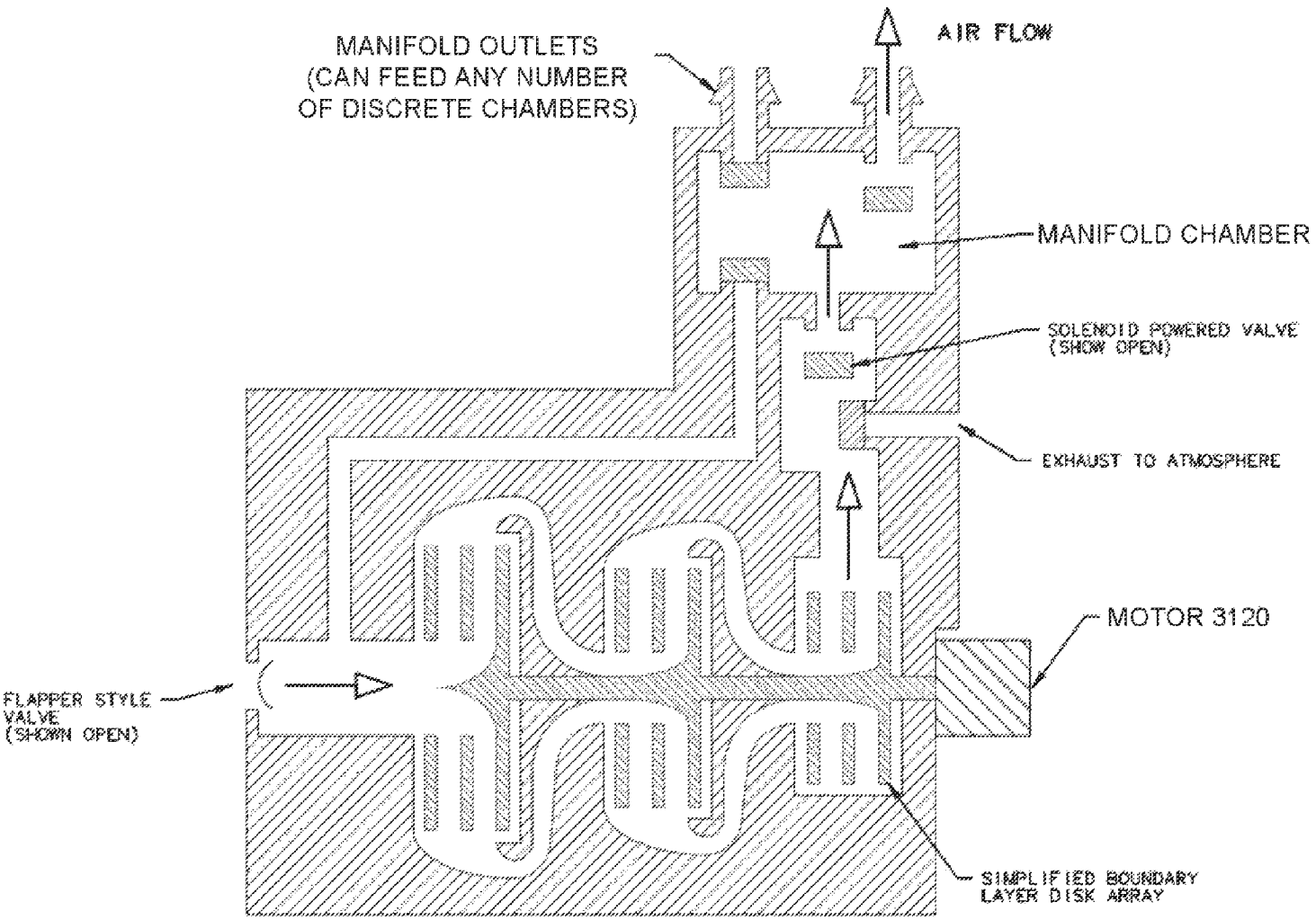
FIG. 31 is a schematic of a cross-sectional view of an integrated pump and manifold capable of powered dumping, utilizing the multi-stage disk array configuration shown in FIG. 30, with arrows showing the direction of airflow during filling operation.

The three-stage configuration 3000 having two annular pressure recovery stages and one involute pressure recovery stage is shown in the context of an integrated housing 3100 in FIG. 31. The integrated housing 3100 allows the boundary-layer pump having motor 3120 and a three-stage configuration to achieve filling operation and powered dumping in a manner that is similar to what was discussed above with respect to FIGS. 18-19 (with the opening and closing of appropriate valves). The arrows in FIG. 31 show the flow of gas through the integrated housing 3100 during a filling operation. It will be appreciated that a pump product utilizing the boundary-layer pump with three stages and pump housing depicted in FIG. 31 will be more complex and more expensive than one that utilizes the single stage configuration shown in FIGS. 18-19, but will also be able to achieve significantly higher pressures. It will further be appreciated that the multi-stage design shown in FIG. 31 (and other variations of annular, involute-shaped, and combination single-stage or multi-stage designs) can be used in one or both sides of the double-sided pump and pump housing designs shown in FIGS. 20-26.

Thus, embodiments of the described invention provide quick, efficient, and cost-effective systems and methods for inflating or deflating an air mattress by using a boundary-layer pump and appropriate manifold housing, and the invention is uniquely suited to applications requiring high flow rates with low to moderate pressure requirements in homogeneous or non-homogeneous compressible fluids. It will also be appreciated, however, that the foregoing methods and implementations are merely examples of the inventive principles, and that these illustrate only preferred techniques. A multitude of different designs are possible based on the principles described herein, including but not limited to: single disk array configurations, multiple disk array configurations using a single motor, multiple disk array configurations using multiple motors, as well as various configurations based on pump-driven or manifold-driven powered dumping. Further, because these pump and pump housing configurations can use reversible or non-reversible motors, more or less valves, more or less complex housing configurations, and different types of pressure recovery chambers, there is a wide gamut of performance and cost requirements that can be satisfied by employing pump and pump housing configurations according to the principles described herein.

It is thus contemplated that other embodiments of the invention may differ in detail from foregoing examples. As such, all references to the invention are intended to reference the particular example of the invention being discussed at that point in the description and are not intended to imply any limitation as to the scope of the invention more generally. All language of distinction and disparagement with respect to certain features is intended to indicate a lack of preference for those features, but not to exclude such from the scope of the invention entirely unless otherwise indicated.

The use of the terms "a" and "an" and "the" and similar refrents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An air mattress pumping system for inflating and deflating an air mattress, the air mattress having a plurality of chambers, the system comprising:

a pumping apparatus, comprising a first pumping element and a second pumping element;

a manifold, configured to connect the first and second pumping elements of the pumping apparatus to the plurality of chambers of the air mattress and configured to be switched between multiple configurations; and means for independently operating each of the first pumping element and the second pumping element in one of multiple modes of operation, the modes of operation including an inflate operation wherein operation of the respective pumping element impels gas entering the pumping apparatus into a chamber of the air mattress and a powered deflate operation wherein operation of the respective pumping element impels gas from a chamber of the air mattress out of the pumping apparatus;

wherein in a first configuration of the manifold, an outlet of the first pumping element is connected to a first chamber of the air mattress and an outlet of the second pumping element is connected to a second chamber of the air mattress;

wherein in a second configuration of the manifold, an inlet of the first pumping element is connected to the first chamber of the air mattress and the outlet of the second pumping element is connected to the second chamber of the air mattress; and wherein in a third configuration of the manifold, the inlet of the first pumping element is connected to the first chamber of the air mattress and an inlet of the second pumping element is connected to the second chamber of the air mattress.

2. The system according to claim 1, wherein operation of the pumping apparatus with the manifold in the second configuration provides a powered deflate operation with respect to the first chamber of the air mattress and an inflate operation with respect to the second chamber of the air mattress.

3. The system according to claim 2, wherein operation of the pumping apparatus with the manifold in the second configuration provides inflation with respect to the second chamber of the air mattress using gas from the first chamber of the air mattress.

4. The system according to claim 1, wherein the first pumping element is a first boundary layer pumping unit including a first pressure recovery chamber and a first plurality of disks within the first pressure recovery chamber, and wherein the second pumping element is a second boundary layer pumping unit including a second pressure recovery chamber and a second plurality of disks within the second pressure recovery chamber.

5. The system according to claim 4, wherein the means for switching the manifold between different configurations comprises:

means for changing the source of and destination for gas impelled through the first and second boundary-layer pumping units between a plurality of potential sources and a plurality of potential destinations, wherein the plurality of potential sources includes an environment external to the system and chambers of the air mattress, and wherein the plurality of destinations includes the environment external to the system and chambers of the air mattress.

6. The system according to claim 4, wherein the means for switching the manifold between different configurations further comprises:

means for isolating a first area of a manifold chamber from a second area of the manifold chamber.

7. The system according to claim 4, wherein the means for switching the manifold between different configurations comprises:

a channel connecting the first boundary-layer pumping unit to the second boundary-layer pumping unit.

8. The system according to claim 4, wherein the means for switching the manifold between different configurations comprises an adjustable plug or sheath.

9. The system according to claim 4, wherein the means for switching the manifold between different configurations comprises a dump channel connecting an inlet of the first boundary-layer pumping unit to a manifold chamber and a valve configured to isolate or connect the inlet of the first boundary-layer pumping unit from or to the manifold chamber via the dump channel.

10. The system according to claim 1, wherein the means for switching the manifold between different configurations comprises a control unit and a user input device connected to the control unit, wherein the connection between the control unit and the user input device is a wireless connection.

* * * * *